US012486552B2

(12) United States Patent
Ikeda et al.

(10) Patent No.: US 12,486,552 B2
(45) Date of Patent: Dec. 2, 2025

(54) STEEL SHEET AND METHOD FOR MANUFACTURING STEEL SHEET

(71) Applicant: NIPPON STEEL CORPORATION, Tokyo (JP)

(72) Inventors: Arisa Ikeda, Tokyo (JP); Kengo Takeda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 445 days.

(21) Appl. No.: 17/927,107

(22) PCT Filed: Aug. 16, 2021

(86) PCT No.: PCT/JP2021/029952
§ 371 (c)(1),
(2) Date: Nov. 22, 2022

(87) PCT Pub. No.: WO2022/070636
PCT Pub. Date: Apr. 7, 2022

(65) Prior Publication Data

US 2023/0193415 A1 Jun. 22, 2023

(30) Foreign Application Priority Data

Sep. 30, 2020 (JP) ..... 2020-165790

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/22*** | (2006.01) |
| ***C22C 38/26*** | (2006.01) |
| ***C22C 38/28*** | (2006.01) |
| ***C22C 38/30*** | (2006.01) |
| ***C22C 38/34*** | (2006.01) |
| ***C22C 38/38*** | (2006.01) |
| ***C22C 38/42*** | (2006.01) |
| ***C22C 38/48*** | (2006.01) |
| ***C22C 38/50*** | (2006.01) |
| ***C22C 38/60*** | (2006.01) |
| ***C25D 3/44*** | (2006.01) |
| ***C25D 5/36*** | (2006.01) |

(52) U.S. Cl.
CPC ..... *C21D 9/46* (2013.01); *C21D 6/001* (2013.01); *C21D 6/002* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/10* (2013.01); *C22C 38/105* (2013.01); *C22C 38/12* (2013.01); *C22C 38/14* (2013.01); *C22C 38/22* (2013.01); *C22C 38/26* (2013.01); *C22C 38/28* (2013.01); *C22C 38/30* (2013.01); *C22C 38/34* (2013.01); *C22C 38/38* (2013.01); *C22C 38/42* (2013.01); *C22C 38/48* (2013.01); *C22C 38/50* (2013.01); *C22C 38/60* (2013.01); *C25D 3/44* (2013.01); *C25D 5/36* (2013.01); *C21D 2211/008* (2013.01)

(58) Field of Classification Search
CPC ..... C21D 9/46; C25D 3/44; C25D 5/36
See application file for complete search history.

(56) References Cited

U.S. PATENT DOCUMENTS

| | | | | |
|---|---|---|---|---|
| 2012/0009434 | A1* | 1/2012 | Hata | C22C 38/12 428/577 |
| 2016/0017468 | A1* | 1/2016 | Kuznetsov | C22C 38/04 420/91 |
| 2019/0119772 | A1 | 4/2019 | Terazawa et al. | |

FOREIGN PATENT DOCUMENTS

| | | | |
|---|---|---|---|
| JP | 2014-47414 | A | 3/2014 |
| JP | 2018-3114 | A | 1/2018 |
| WO | WO 2017/183057 | A1 | 10/2017 |

* cited by examiner

*Primary Examiner* — Ricardo D Morales
(74) *Attorney, Agent, or Firm* — Birch, Stewart, Kolasch & Birch, LLP

(57) ABSTRACT

In a steel sheet according to the present embodiment, a Ti content and a N content satisfy Ti−3.5×N≥0.003, at a sheet thickness ¼ position, a metallographic structure includes 90% or more of martensite in terms of volume fraction, at the sheet thickness ¼ position, a number density of TiC having a circle equivalent diameter of 1 to 500 nm is $3.5\times10^4$ particles/mm$^2$ or more, at the sheet, thickness ¼ position, a value of a median value of a Mn concentration+3σ is 5.00% or less, and a hardness measured at the sheet thickness ¼ position is 1.30 times or more a hardness measured at a position 50 μm deep from a surface of the steel sheet.

7 Claims, No Drawings

STEEL SHEET AND METHOD FOR MANUFACTURING STEEL SHEET

TECHNICAL FIELD OF THE INVENTION

The present invention, relates to a steel sheet and a method for manufacturing a steel sheet.

Priority is claimed on Japanese Patent Application No. 2020-165790, filed on Sep. 30, 2020, the content of which is incorporated herein by reference.

RELATED ART

In order to suppress the amount of carbon dioxide exhausted from automobiles, attempts are underway to reduce the weights of automobile vehicle bodies while ensuring safety by using high strength steel sheets. However, in general, when the strength of a steel sheet is increased, delayed fracture is likely to occur. Delayed fracture is a phenomenon in which hydrogen that intrudes into steel from the environment due to corrosion or the like degrades the strength and fracture properties of the steel to cause cracking and fracture. The higher the strength of the steel sheet, the higher the susceptibility to delayed fracture, From the viewpoint of further increasing the strength of mechanical parts, high strength steel sheets that are applied to mechanical parts are required to have excellent delayed fracture resistance properties, Here, "delayed fracture resistance properties" are an index of resistance to delayed fracture. A steel sheet that does not easily allow the occurrence of delayed fracture is judged to have favorable delayed fracture resistance properties.

In addition, high strength steel sheets that are used for mechanical parts are also required to have an excellent balance between strength and ductility in order to ensure both the stiffness of the mechanical parts and the easiness of manufacture. Here, "balance between strength and ductility" is a value that is evaluated by a value obtained by multiplying the tensile strength TS and the elongation EL of the steel sheet.

In addition, from the viewpoint of prolonging the service lives of mechanical parts, high strength steel sheets that are applied to mechanical parts are also required to, have excellent fatigue resistance properties. The fatigue resistance properties are a value that is evaluated by, for example, a yield ratio. The yield ratio is a value obtained by dividing the yield stress by the tensile strength.

Examples of the prior arts of high strength steel sheets include the followings.

Patent Document 1 discloses a high strength hot rolled steel sheet having excellent external appearance and excellent isotropy of toughness and yield strength, having a chemical composition including, by mass % C: 0.04% or more and 0.15% or less, Si: 0.01% or more and 0.25% or less, Mn: 0.1% or more and 2.5% or less, P: 0.1% or less, S: 0.01% or less, Al: 0.005% or more and 0.05% or less, N: 0.01% or less, Ti: 0.01% or more and 0.12% or less, B: 0.0003% or more and 0.0050% or less, and a remainder: Fe and unavoidable impurities, in which 90% or more of the structure is martensite, the amount of TiC precipitated is 0.05% or less, and the cleanliness of an A-based inclusion that is defined in JIS G 0202 is 0.010% or less.

However, in Patent Document 1, no studies are made on delayed fracture. In addition, in the steel sheet described in Patent Document 1, the C content is 0.15% or less, and the tensile strength is roughly 1300 MPa or less. Patent Document 1 does not suggest a method for improving the delayed fracture resistance properties of a high strength steel sheet having a C content, of 020% or more.

Patent Document 2 discloses a high strength steel sheet, in which the composition contains, by mass %, C: 0.20% or more and less than 0.45%, Si: 0.50% or more and 2.50% or less, Mn: 1.5% or more and 4.0% or less, P: 0.050% or less, S: 0.0050% or less, Al: 0.01% or more and 0.10% or less, Ti: 0.020% or more and 0.150% or less, N: 0.0005% or more and 0.0070% or less, O: 0.0050% or less, and a remainder consisting of iron and unavoidable impurities, the structure includes, in terms of area ratio, 30% or more and 70% or less of ferrite and bainite in total, 15% or more of residual austenite, and 5% or more and 35% or less of martensite, an average circle equivalent diameter of the residual austenite is 3.0 μm or less, in the structure, the total number of TiC and a composite precipitates containing TiC, which have a major axis of 5 nm or more and 100 nm or less, is $2\times10^5$ or more per 1 $mm^2$, and the total number of carbides nitrides, and oxides all containing Ti and composite precipitates containing them, which have a major axis of 250 nm or more, is $8\times10^3$ or less per 1 $mm^2$.

However, in the steel sheet described in Patent Document 2, as a way for detoxifying hydrogen that has intruded into steel, only the control of the Mn content and the P content is provided. Therefore, even in the steel sheet described in Patent Document 2, there is room for further improving the delayed fracture resistance properties.

Patent Document 3 discloses a wear-resistant steel sheet, in which the composition contains, by mass %, C: 0.20% to 0.45%, Si: 0.01% to 1.0%, Mn: 0.3% to 2.5%, P: 0.020% or less, S: 0.01% or less Cr: 0.01% to 2.0%, Ti: 0.10% to 1.00%, B: 0.0001% to 0.0100%, Al: 0.1% or less, N: 0.01% or less, and a remainder consisting of Fe and unavoidable impurities, in the structure, the volume fraction of martensite at a depth of 1 mm from the surface of the wear-resistant steel sheet is 90% or more, and the prior austenite grain size, at the thickness middle portion of the wear-resistant steel sheet is 80 μm or less, the number density of TiC precipitates having a size of 0.5 μm or more at the depth of 1 mm from the surface of the wear-resistant steel sheet is 400 precipitates/$mm^2$ or more, and the concentration of Mn [Mn] (mass %) and the concentration of P [P] (mass %) at the sheet thickness center segregation portion satisfy $0.04[Mn]+[P]<0.50$.

However, in the steel sheet described in Patent Document 3, coarse TiC is used to improve the wear resistance. According to the present inventors' findings, the coarsening of TiC is considered to impair the delayed fracture resistance properties.

PRIOR ART DOCUMENT

Patent Document

[Patent Document 1] Japanese Unexamined Patent Application, First Publication No. 2014-47414

[Patent Document 2] Japanese Unexamined Patent Application, First Publication No. 2018-3114

[Patent Document 3] PCT International Publication No. WO 2017/183057

DISCLOSURE OF THE INVENTION

Problems to be Solved by the Invention

An object of the present invention is to provide a steel sheet having a high strength, an excellent balance between strength and ductility, excellent delayed fracture resistance properties, and, furthermore, excellent fatigue resistance properties, and a method for manufacturing the same.

Means for Solving the Problem

The gist of the present invention is as described below.

(1) A steel sheet according to one aspect of the present invention includes, as a chemical composition, in a unit of mass %, C: 0.20% or more and 0.45% or less, Si: 0.01% or more and 2.50% or less, Mn: 1.20% or more and 3.50% or less, P: 0.040% or less, S: 0.010% or less, Al: 0.001% or more and 0.100% or less, N: 0.0001% or more and 0.0100% or less, Ti: 0.005% or more and 0.100% or less, B 0% or more and 0.010% or less, O: 0.006% Or less, Mo: 0% or more and 0.50% or less, Nb: 0% or more and 0.20% or less, Cr: 0% or more and 0.50% or less, V: 0% or more and 0.50% or less, Cu: 0% or more and 1.00% or less. W: 0% or more and 0.100% or less, Ta: 0% or more and 0.10% or less, Ni: 0% or more and 1.00% or less Sn: 0% or more and 0.050% or less, Co: 0% or more and 0.50% or less, Sb: 0% or more and 0.050% or less, As: 0% or more and 0.050% or less Mg: 0% or more and 0.050% or less, Ca: 0% or more and 0.040% or less, Y: 0% or more and 0.050% or less, Zr: 0% or more and 0.050% or less, La: 0% or more and 0.050% or less, Ce: 0% or more and 0.050% or less, and a remainder consisting of Fe and impurities, in which a Ti content, and a N content satisfy the following formula 1, at a sheet thickness ¼ position, a metallographic structure includes 90% or more of martensite in terms of volume fraction, at the sheet thickness ¼ position, a number density of TiC having a circle equivalent diameter of 1 to 500 nm is $3.5\times10^4$ particles/mm$^2$ or more, at the sheet thickness ¼ position, a value of a median value of a Mn concentration+3σ is 5.00% or less, a hardness measured at the sheet thickness ¼ position is 1.30 times or more a hardness measured at a position 50 μm deep from a surface of the steel sheet, and a tensile strength is 1310 MPa or more.

$$Ti-3.5\times N\geq 0.003 \quad \text{(formula 1)}$$

Here, element symbols Ti and N in the formula 1 mean the Ti content and the N content of the steel sheet.

(2) The steel sheet according, to (1) may include hot-dip galvanizing, hot-dip galvannealing, electro plating, or aluminum plating.

(3) A method for manufacturing a steel sheet according to another aspect of the present invention includes hot-rolling a cast piece having the chemical composition according to (1) with a finish rolling end temperature set to an Ac3 point or higher to obtain a steel sheet, coiling the steel sheet at a coiling temperature set to 500° C. or lower, cold-rolling the steel sheet at a rolling reduction set to 0% to 20%, and annealing the steel sheet in a temperature range of the Ac3 point or higher with an oxygen potential in a temperature range of 700° C. or higher set to −1.2 or higher and 0 or lower, in which, when the steel sheet is heated up to the temperature range of the Ac3 point or higher in the annealing, the steel sheet is held in a temperature, range of 500° C. to 700° C. for 70 to 130 seconds, and, when the steel sheet is cooled from the temperature range; of the Ac3 point or higher in the annealing, the steel sheet is held in a temperature range of 700° C. to 500° C. for 4 to 25 seconds.

(4) The method for manufacturing a steel sheet according to (3) may further include tempering the annealed steel sheet.

(5) The method for manufacturing a steel sheet according to (3) or (4) may further include performing hot-dip galvanizing, hot-dip galvannealing, electro plating, or aluminum plating on the annealed steel sheet.

Effects of the Invention

According to the present invention, it is possible to provide a steel sheet having a high strength, an excellent balance between strength and ductility, excellent delayed fracture resistance properties, and, furthermore, excellent fatigue resistance properties, and a method for manufacturing the same.

EMBODIMENTS OF THE INVENTION

The present inventors, paid attention to TiC as a way for improving the delayed fracture resistance properties. TiC acts as a hydrogen-trapping site and is thus capable of detoxifying hydrogen that has intruded into steel.

However, from coarse TiC having a circle equivalent diameter of more than 500 nm, the above-described effect cannot be sufficiently obtained. In order to improve the delayed fracture resistance properties through TiC, it is necessary to disperse a large amount of fine TiC having a circle equivalent diameter of 1 to 500 nm in the steel sheet. The present inventors repeated studies regarding a way for finely dispersing TiC. As a result, the present inventors found that annealing a steel sheet manufactured as described below is extremely effective for finely dispersing TiC.

(A) The structure of the steel sheet before annealing is made to include mainly bainite and/or martensite.

(B) Ti is contained in a solid solution state in the steel sheet before annealing.

(C) The amount of dislocation introduced into the steel sheet before annealing by cold rolling is controlled.

(D) The temperature of the steel sheet is held within a temperature range of 500° C. to 700° C. during heating for annealing and cooling after annealing.

(A) First, it is preferable that the structure of the steel sheet before annealing is made to include mainly bainite and/or martensite. Such a low temperature transformation structure includes a number of dislocations. The use of these dislocations as TiC precipitation sites makes it possible to finely precipitate TiC in the steel sheet when the temperature is raised to anneal the steel sheet.

In addition, dislocations and grain boundaries that are included in this low temperature transformation structure reduce the segregation of Mn during the annealing of the steel sheet, which makes it, possible to further improve the properties of the steel sheet. Therefore, mainly including bainite and/or martensite in the structure of the steel sheet before annealing is also effective for reducing Mn segregation. In addition, the structure of the steel sheet before annealing once transforms into austenite during annealing. Therefore, it should be noted that the structure of the steel sheet after annealing does not necessarily match the structure of the steel sheet before annealing.

(B) Next, it is preferable that Ti is contained in a solid solution state in the steel sheet before annealing. It is normal to use Ti as a nitrogen-fixing element in high strength steel sheets containing Ti. N is an element that bonds to B to form BN and impairs the hardenability improvement, effect of B. On the other hand, N bonds to to form TiN. Therefore, when Ti is contained in the steel sheet and TiN is formed using Ti, it is possible to enhance the hardenability of the steel sheet and to increase the strength of the steel sheet.

However, in a method for manufacturing the steel sheet according to the present embodiment, it is preferable to make Ti present in a solid solution state in steel in stages before annealing. This is because Ti, which is present as TiN in stages before annealing, does not form TiC in the annealing process. When Ti is made to form a solid solution in the matrix in the steel sheet before annealing, the Ti solid solution forms TiC at the time of temperature rise for annealing.

(C) Furthermore, the introduction of dislocations into the steel sheet before annealing is controlled. As described above, dislocations that are included in the steel sheet before annealing have an effect of reducing Mn segregation during annealing. This is because, on the other hand, when a steel sheet having an excessive amount of dislocation is annealed, the dislocation promotes the recrystallization of the structure of the steel sheet at the time of temperature rise, and the grain sizes of the steel sheet during the temperature rise are increased.

Grain boundaries in the steel sheet during temperature rise for annealing act as TiC precipitation sites. As the grain sizes of the steel sheet during temperature rise are finer, the number of grain boundaries, which are TiC precipitation sites, increases, and the number density of TiC increases. In other words, when the amount of dislocation in the steel sheet before annealing is excessive, at the time of temperature rise for annealing, TiC becomes coarse, and the number density thereof becomes insufficient.

In a case where the structure of the steel sheet before annealing has been made to mainly include bainite and/or martensite, dislocations derived from the low temperature, transformation structure are already included in the steel sheet to no small extent. Therefore, it is preferable to prevent the amount of dislocation from becoming excessive by reducing the rolling reduction in cold rolling or skipping cold rolling (in other words, setting the cold rolling reduction to 0%).

(D) Additionally, the temperature of the steel sheet is held within a temperature range of 500° C. to 700° C. during heating for annealing and cooling after annealing.

TiC is precipitated in the temperature range of 500° C. to 700° C. When the temperature of the steel sheet is held in the temperature range of 500° C. to 700° C. for a certain period of time at the time of heating for annealing, Ti present in steel in a solid solution state can be precipitated as fine TiC having a circle equivalent diameter of 1 to 500 nm.

However, part of TiC precipitated at, the time of heating dissolves when the temperature of the steel sheet is held within the temperature range of the Ac3 point or higher. Therefore, at the time of cooling after annealing, it is necessary to re precipitate TiC by holding the temperature of the steel sheet in the temperature range of 500° C. to 700° C. for a certain period of time.

The present inventors found that the synergistic effect of the above-described elements (A) to (D) makes TiC in the steel sheet significantly refined and increases the number density thereof. Additionally, the present inventors also found that the delayed fracture resistance properties are further improved by forming a soft layer formed by decarburization or the like on the surface of a steel sheet containing fine TiC having a circle equivalent diameter of 1 to 500 nm. Furthermore, the present inventors found that finely dispersed TiC has an action of improving not only the delayed fracture resistance properties but also the fatigue strength of the steel sheet.

The steel sheet according to the present embodiment obtained based on these findings will be described in detail below.

First, the chemical composition of the steel sheet according to the present embodiment will be described. Here, the unit "%" for the contents of alloying elements refers to "mass %". As described above, the steel sheet according to the present embodiment has a soft layer on the surface layer, but the chemical composition to be described below is a chemical composition in places other than the soft layer. Therefore at the time of measuring the chemical composition of the steel sheet, it is necessary to set a place sufficiently distant from the surface layer (for example, the thickness middle portion) as the measurement region.

(C: 0.20% or More and 0.45% or Less)

C is an element that improves the strength of the steel sheet. In order to obtain a sufficient tensile strength, the C content needs to be set to 0.20% or more. The C content may be set to 0.200% or more, 0.22% or more, 0.25% or more, or 0.30% or more.

On the other hand, when the C content is excessive, deterioration of the delayed, fracture resistance properties is caused, and the weldability significantly deteriorates. Therefore, the C content is set to 0.45% or less. The C content may be set to 0.450% or less, 0.42% or less, 0.40% or less or 0.35% or less.

(Si: 0.01% or More and 2.50% or Less)

Si is an element that improves the strength of the steel sheet by causing solid solution strengthening in the steel sheet and, furthermore, suppressing the temper softening of martensite. In order to obtain this effect, the Si content is set to 0.01% or more. The Si content may be set to 0.10% or more, 0.20% or more, or 0.50% or more.

On the other hand, when the Si content is excessive, there is a concern that the ductility of the steel sheet may be impaired, which makes it difficult to use the steel sheet as a material for mechanical parts. In addition, when the Si content is excessive, the plateability deteriorates, and non-plating is likely to occur. Therefore, the Si content is set to 2.50% or less. The Si content may be set to 2.00% or less, 1.50% or less, or 1.00% or less.

(Mn: 1.20% or More and 3.50% or Less)

Mn is an element that improves the hardenability of the steel sheet and improves the strength of the steel sheet. In order to obtain these effects, the Mn content is set to 1.2% or more or 1.20% or more. The Mn content may be set to 1.5% or more, 1.50% or more, 1.8% or more, 1.80% or more, 2.0% or more, or 2.00% or more.

On the other hand, when the Mn content is excessive, there is a concern that the plateability, workability, and weldability may deteriorate. Therefore, the Mn content is set to 3.5% or less or 3.50% or less. The Mn content may be set to 3.2% or less, 3.20% or less, 3.0% or less, 3.00% or less, 2.5% or less, or 2.50% or less.

(P: 0.040% or Less)

P is an element that segregates at grain boundaries and embrittles the steel sheet and is preferably as little as possible. Therefore, the P content may be 0%. On the other hand, when the P content is excessively reduced, the refining cost increases. 0.040% or less of P is permitted in the steel sheet according to the present embodiment. The P content may be set to 0.001% or more, 0.005% or more, or 0.010% or more. The P content may be set to 0.0400% or less, 0.035% or less, 0.030% or less, or 0.020% or less.

(S: 0.010% or Less)

S is an element that causes hot embrittlement and impairs weldability and corrosion resistance and is thus preferably as little as possible. Therefore, the S content may be 0%. On the other hand, when the S content is excessively reduced, the refining cost increases. 0,010% or less of S is permitted in the steel sheet according to the present embodiment. The S content may be set to 0.001% or more, 0.003% or more, or 0.005% or more. The S content may be set to 0.0100% or less, 0.009% or less, 0.008% or less, or 0.007% or less.

(Al: 0.001% or More and 0.100% or Less)

Al is an element having a deoxidation effect. In addition, Al is an element that suppresses the formation of an iron-based carbide and improves the strength of the steel sheet. In order to obtain these effects, the Al content is set to 0.001% or more. The Al content may be set to 0.005% or more, 0.010% or more, or 0,020% or more.

On the other hand, when the Al content is excessive, there is a concern that the ferrite fraction may increase and the strength of the steel sheet may be impaired. Therefore, the Al content is set to 0.100% or less. The Al content may be set to 0.080% or less, 0.050% or less, or 0.030% or less.

(N: 0.0001% or More and 0.0100% or Less)

N is an element that bonds to Ti to form TiN and thereby reduces the amount of TiC formed and is preferably as, little as possible. Therefore, from the viewpoint of ensuring the properties of the steel sheet according to the present embodiment, the N content may be 0%. On the other hand, when the N content is excessively reduced, the refining cost increases, and thus the lower limit of the N content is set to 0.0001%. 0.0100% or less of N is permitted in the steel sheet according to the present embodiment. The N content may be set to 0.0001% or more, 0.0002% or more, or 0.0005% or more. The N content may be set to 0.0090% or less, 0.0085% or less, or 0.0080% or less.

(Ti: 0.005% or More and 0.100% or Less)

Ti is an element that bonds to C to form TiC. TiC acts as a hydrogen-trapping site and thereby improves the delayed fracture resistance properties. In addition, TiC refines prior austenite grains by an austenite pinning effect and suppresses intergranular fracture cracking to improve the delayed fracture resistance properties. In order to obtain these effects, the Ti content is set to 0.005% or more. The Ti content may be set to 0,010% or more, 0.020% or more, or 0.030% or more.

On the other hand, when the Ti content is excessive, the effects are saturated, and the manufacturing cost increases. Furthermore, when the Ti content is excessive, a large amount of TiC is precipitated, and the amount of a C solid solution decreases, and thus the tensile strength is impaired in some cases. Therefore, the Ti content is set to 0.100% or less. The Ti content may be set to 0.080% or less, 0.060% or less, or 0.050% or less.

(B: 0% or More and 0.010% or Less)

B is not essential for achieving the object of the steel sheet according to the present embodiment. Therefore, the lower limit of the B content is 0%. Incidentally, B is capable of improving the hardenability of the steel sheet. In order to obtain this effect, the B content may be set to 0.001% or more, 0.002% or more, or 0.005% or more. However, when the B content is excessive, the effect is saturated, and the manufacturing cost increases. Therefore, the B content may be set to 0.010% or less, 0.0100% or less, 0.009% or less, or 0.008% or less.

(O: 0.006% or Less)

O is an element that forms various oxides and adversely affects the mechanical properties of the steel sheet and is thus preferably as little as possible. Therefore, the O content may be 0%. On the other hand, when the O content is excessively reduced, the refining cost increases. 0.006% or less of O is permitted in the steel sheet according to the present embodiment. The O content may be set to 0.001% or more, 0.002% or more, or 0.003% or more. The O content may be set to 0.005% or less, 0.004% or less, or 0.003% or less.

(Mo: 0% or More and 0.50% or Less)

Mo is not essential for achieving the object of the steel sheet according to the present embodiment. Therefore, the lower limit of the Mo content is 0%. Incidentally, Mo is capable of improving the hardenability of the steel sheet. In order to obtain this effect, the Mo content may be set to 0.001% or more, 0.005% or more, or 0.010% or more. However, in a case where the Mo content is excessive, the pickling property, weldability, hot workability, or the like of the steel sheet may deteriorate. Therefore, the Mo content may be set to 0.50% or less, 0.500% or less, 0.30% or less, or 0.20% or less.

(Nb: 0% or More and 0.20% or Less)

Nb is not essential for achieving the object of the steel sheet according to the present embodiment. Therefore, the lower limit of the Nb content is 0%. Incidentally, Nb is capable of reducing the grain sizes of the steel sheet and further enhancing the toughness. In order to obtain these effects, the Nb content may be set to 0.001% or more, 0.005% or more, or 0.010% or more. However, when the Nb content is excessive, the effect is saturated, and the manufacturing, cost increases. Therefore, the Nb content may be set to 0.20% or less, 0.200% or less, 0.10% or less, or 0.050% or less.

(Cr: 0% or More and 0.50% or Less)

Cr is not essential for achieving the object of the steel sheet according to the present embodiment. Therefore, the lower limit of the Cr content is 0%. Incidentally, Cr is capable of improving the hardenability of the steel sheet. In order to obtain these effects, the Cr content may be set to 0.001% or more, 0.002% or more, or 0.005% or more. However, when the Cr content is excessive, there is a concern that the ductility of the steel sheet may deteriorate. Therefore, the Cr content may be set to 0.50% or less, 0.500% or less 0.30% or less, or 0.10% or less.

(V: 0% or More and 0.50% or Less)

V is not essential for achieving the object of the steel sheet according to the present embodiment. Therefore, the lower limit of the V content is 0%. Incidentally, V is capable of forming a carbide to refine the structure and improving the toughness of the steel sheet. In order to obtain this effect, the V content may be set to 0.01% or more, 0.05% or more, or 0.10% or more. However, when the V content is excessive, there is a concern that the formability of the steel sheet may deteriorate. Therefore, the V content may be set to 0.50% or less, 0.500% or less, 0.40% or less, or 0.30% or less.

(Cu: 0% or More and 1.00% or Less)

Cu is not essential for achieving the object of the steel sheet according to the present embodiment. Therefore, the lower limit of the Cu content is 0%. Incidentally, Cu is an element that contributes to improvement in the strength of the steel sheet. In order to obtain this effect, the Cu content may be set to 0.01% or more, 0.05% or more, or 0.10% or more. However, in a case where the Cu content is excessive, the pickling property, weldability, hot workability, or the like of the steel sheet may deteriorate. Therefore, the Cu content may be set to 1.00% or less, 1.000% or less, 0.80% or less, or 0.30% or less.

(W: 0% or More and 0.100% or Less)

W is not essential for achieving the object of the steel sheet according to the present embodiment. Therefore, the lower limit of the W content is 0%. Incidentally, W-containing precipitates and crystallized substances act as hydrogen-trapping sites. In order to obtain this effect, the W content may be set to 0.01% or more, 0.02% or more, or 0.03% or more. However, in a case where the W content is excessive, since coarse W precipitates or crystallized substances are formed, cracking is likely to occur in these coarse W precipitates or crystallized substances, and cracks propagate in steel materials due to a love load stress, the delayed fracture resistance properties (hydrogen embrittlement resistance) may deteriorate. Therefore, the W content may be set to 0.09% or less, 0.090% or less, 0.08% or less, 0.080% or less, or 0.030% or less.

(Ta: 0% or More and 0.10% or Less)

Ta is not essential for achieving the object of the steel sheet according to the present embodiment. Therefore, the lower limit of the Ta content is 0%. Incidentally, Ta is capable of forming a carbide to refine the structure and improving the toughness of the steel sheet. In order to obtain this effect, the Ta content may be set to 0.01% or more, 0.02% or more, or 0.03% or more. However, when the Ta content is excessive, there is a concern that the formability of the steel sheet may deteriorate. Therefore, the Ta content may be set to 0.10% or less, 0.100% or less, 0.09% or less, 0.08% or less, or 0.03% or less.

(Ni: 0% or More and 1.00% or Less)

Ni is not essential for achieving the object of the steel sheet according to the present embodiment. Therefore, the lower limit of the Ni content is 0%. Incidentally, Ni is an element that contributes to improvement in the strength of the steel sheet. In order to obtain this effect, the Ni content may be set to 0.01% or more, 0.05% or more, or 0.10% or more. However, in a case where the Ni content is excessive, there is a concern that the manufacturability during manufacture may be adversely affected or the delayed fracture resistance properties may deteriorate. Therefore, the Ni content may be set to 1.00% or less, 1.000% or less, 0.80% or less, or 0.30% or less.

(Co: 0% or More and 0.50% or Less)

Co is not essential for achieving the object of the steel sheet according to the present embodiment. Therefore, the lower limit of the Ccs content is 0%, Incidentally, Co is an element that contributes to improvement in the strength of the steel sheet. In order to obtain this effect, the Co content may be set to 0.01% or more, 0.05% or more, or 0.10% or more. However, in a case where the Co content is excessive, since precipitation of coarse Co carbides is caused, and cracks are initiated from these coarse Co carbides as base points, there is a concern that the delayed fracture resistance properties may deteriorate. Therefore, the Co content may be set to 0.50% or less, 0.500% or less, 0.30% or less, or 0.20% or less.

(Mg: 0% or More and 0.050% or Less)

Mg is not essential for achieving the object of the steel sheet according to the present embodiment. Therefore, the lower limit of the Mg content is 0%. Incidentally, Mg controls the form of sulfides or oxides and contributes to improvement in the bending formability of the steel sheet. In order to obtain these effects, the Mg content may be set to 0.001% or more, 0.005% or more, or 0.010% or more. However, in a case where the Mg content is excessive, there is a concern that the formation of coarse inclusions may cause the deterioration of the delayed fracture resistance properties. Therefore, the Mg content may be set to 0.050% or less, 0.040% or less, or 0.020% or less.

(Ca: 0% or More and 0.040% or Less)

Ca is not essential for achieving the object of the steel sheet according to the present embodiment. Therefore, the lower limit of the Ca content is 0%. Incidentally, Ca controls the form of sulfides or oxides and contributes to improvement in the bending formability of the steel sheet. In order to obtain these effects, the Ca content may be set to 0.001% or more, 0.005% or more, or 0.010% or more. However, in a case where the Ca content is excessive, there is a concern that the formation of coarse inclusions may cause the deterioration of the delayed fracture resistance properties. Therefore, the Ca content may be set to 0.040% or less, 0.030% or less, or 0.020% or less.

(Y: 0% or More and 0.050% or Less)

Y is not essential for achieving the object of the steel sheet according to the present embodiment. Therefore, the lower limit of the Y content is 0%. Incidentally, Y controls the form of sulfides or oxides and contributes to improvement in the bending formability of the steel sheet. In order to obtain these effects, the Y content may be set to 0.001% or more, 0.005% or more, or 0.010% or more. However, in a case where the Y content is excessive, there is a concern that the formation of coarse inclusions may cause the deterioration of the delayed fracture resistance properties. Therefore, the Y content may be set to 0.050% or less, 0.040% or less, or 0.020% or less.

(Zr: 0% or More and 0.050% or Less)

Zr is not essential for achieving the object of the steel sheet according to the present embodiment. Therefore, the lower limit of the Zr content is 0%. Incidentally, Zr controls the form of sulfides or oxides and contributes to improvement in the bending formability, of the steel sheet. In order to obtain these effects, the Zr content may be set to 0.001% or more, 0.005% or more, or 0.010% or more. However, in a case where the Zr content is excessive, there is a concern that the formation of coarse inclusions may cause the deterioration of the delayed fracture resistance properties. Therefore, the Zr content may be set to 0.050% or less, 0.040% or less, or 0.020% or less.

(La: 0% or More and 0.050% or Less)

La is not essential for achieving the object of the steel sheet according to the present embodiment. Therefore, the lower limit of the La content is 0% Incidentally, La controls the form of sulfides or oxides and contributes to improvement in the bending formability of the steel sheet. In order to obtain these effects, the La content may be set to 0.001% or more, 0.005% or more, or 0.010% or more. However, in a case where the La content is excessive, there is a concern that the formation of coarse inclusions may cause the deterioration of the delayed fracture resistance properties. Therefore, the La content may be set to 0.050% or less, 0.040% or less, or 0.020% or less.

(Ce: 0% or More and 0.050% or Less)

Ce is not essential for achieving the object of the steel sheet according to the present embodiment. Therefore, the lower limit of the Ce content is 0%. Incidentally, Ce controls the form of sulfides or oxides and contributes to improvement in the bending formability of the steel sheet. In order to obtain, these effects, the Ce content may be set to 0.001% or more, 0.005% or more, or 0.010% or more. However, in a case where the Ce content is excessive, there is a concern that the formation of coarse inclusions may cause the deterioration of the delayed fracture resistance properties. Therefore, the Ce content may be set to 0.050% or less, 0.040% or less, or 0.020% or less.

The remainder of the chemical composition of the steel sheet according to the present embodiment contains Fe and impurities. The impurity refers to a component that is incorporated from, for example, a raw material such as an ore or a scrap or from a variety of causes in manufacturing steps during the industrial manufacturing of a steel material and is allowed to be contained, as long as the impurity does not adversely affect the steel sheet according to the present embodiment. Examples of the impurities include Sn, Sb, and As. However, Sn, Sb, and As are only examples of the impurities.

(Sn: 0% or More and 0.050% or Less)

Sn is an element that can be contained in the steel sheet in the case of using a scrap as a raw material of the steel sheet. In, addition, there is a concern that the deterioration of the cold formability of the steel sheet may be caused. Therefore, the Sn content is preferably as small as possible. Therefore, the Sn content may be 0%. On the other hand, when the Sn content is excessively reduced and set to less than 0.001%, the refining cost increases. Therefore, the Sn content may be set to 0.001% or more, 0.002% or more, or 0.003% or more. In addition, 0.050% or less of Sn is permitted in the steel sheet according to the present embodiment. The Sn content may be set to 0.040% or less, 0.030% or less, or 0.020% or less.

(Sb: 0% or More and 0.050% or Less)

Sb is an element that can be contained in the steel sheet in the case of using a scrap as a raw material of the steel sheet. In addition, there is a concern that Sb may be segregated in grain boundaries to cause the embrittlement of the grain boundaries and the deterioration of the ductility or the deterioration of the cold formability may be caused. Therefore, the Sb content is preferably as small as possible. Therefore, the Sb content may be 0%. On the other hand, when the Sb content is excessively reduced and set to less than 0.001%, the refining cost increases. Therefore, the Sb content may be set to 0.001% or more, 0.002% or more, or 0.003% or more. In addition, 0.050% or less of Sb is permitted in the steel sheet according to the present embodiment. The Sb content may be set to 0.040% or less, 0.030% or less, or 0.020% or less.

(As: 0% or More and 0.050% or Less)

As is an element that can be contained in the steel sheet in the case of using a scrap as a raw material of the steel sheet. In addition, there is a concern that As may be segregated in grain boundaries to cause the embrittlement of the grain boundaries and the deterioration of the ductility or the deterioration of the cold formability may be caused. Therefore, the As content is preferably as small as possible. Therefore, the As content may be 0%. On the other hand, when the As content is excessively reduced and set to less than 0.001%, the refining cost increases. Therefore, the As content may be set to 0.001% or more, 0.002% or more, or 0,003% or more. Incidentally, 0.050% or less of As is permitted in the steel sheet according to the present embodiment. The As content may be set to 0.040% or less, 0.030% or less, or 0.020% or less.

(Relationship Between Ti Content and N Content)

In the steel sheet according to the present embodiment, TiC is used to improve the delayed fracture resistance properties. In order to finely disperse a large amount of TiC, it is preferable to anneal a steel sheet in which Ti is contained in a solid solution state as described above. However, N that is contained in steel bonds to Ti to form TiN and reduces the amount of Ti that is contained in steel in a solid solution state (Ti solid solution).

In order to ensure a sufficient amount of the Ti solid solution in the steel sheet before annealing, in the steel sheet according to the present embodiment, the Ti content and the N content need to satisfy the following formula 1.

$$Ti-3.5\times N\geq 0.003 \quad \text{(formula 1)}$$

Here, the element symbols Ti and N in the formula 1 mean the Ti content and the N content of the steel sheet. "Ti−3.5×N" refers to the amount of Ti that does not form TiN on the assumption that all N that is contained in the steel sheet has bonded to Ti. It is presumed that "Ti−3.5×N" in the steel sheet before the precipitation of TiC by annealing or the like roughly matches the amount of the Ti solid solution. Therefore, it is presumed that, in the steel sheet where the chemical composition, satisfies the formula 1, the amount of the Ti solid solution is approximately 0.003 mass % or more. When the chemical composition of the steel sheet is controlled so as to satisfy the formula 1, it is possible to sufficiently ensure the Ti solid solution, which will act as the material of TiC, in the steel sheet before annealing. "Ti−3.5×N" may be set to 0.005 or more, 0.010 or more, 0.015 or more, or 0.020 or more.

The upper limit of Ti−3.5×N is not particularly limited. The Ti−3.5×N value "0.0965" when the Ti content is the maximum value within the above-described range and the N content is the minimum value within the above-described range is the substantial upper limit of Ti−3.5×N. In addition, Ti−3.5×N may be set to 0.095 or less, 0.092 or, less, 0.090 or less, 0.080 or less, or 0.060 or less.

Next, the metallographic structure, Mn segregation state, and inclusions of the steel sheet according to the present embodiment will be described. In addition, evaluation methods thereof will also be described together. The metallographic structure, the Mn segregation state, and the inclusions are all evaluated at the sheet thickness ¼ position. The sheet thickness ¼ position is a position at a depth of approximately ¼ of the thickness of the steel sheet from the surface of the steel sheet. The sheet thickness ¼ position is the middle point between the surface of the steel sheet where the temperature is most likely to fluctuate during a heat treatment and the center in the sheet thickness direction of the steel sheet where the temperature is most unlikely to fluctuate, that is, the sheet thickness ½ position. Therefore, the structure at the sheet thickness ¼ position can be regarded as a structure representing the structure of the overall steel sheet.

(Metallographic Structure at Sheet Thickness ¼ Position: 90% or More of Martensite in Terms of Volume Fraction and Remainder in Microstructure)

In the steel sheet according to the present embodiment, the metallographic structure at the sheet thickness ¼ position contains 90% or more of martensite in terms of volume fraction. This makes it possible to impart an excellent strength (for example, a tensile strength of 1310 to 1760 MPa) to the steel sheet. The volume fraction of martensite at the sheet thickness ¼ position may be 92% or more, 95% or more, 98% or more, or 100%.

The remainder of the metallographic structure at the sheet thickness ¼ position is not particularly limited. For example, a total of 10% or less of residual austenite, ferrite pearlite, bainite, and the like may be included in the metallographic structure at the sheet thickness ¼ position. In addition, "martensite" in the present embodiment is a concept including both tempered martensite and fresh martensite (martensite that is not tempered). Therefore, the volume fraction of martensite is the total value of the volume fractions of fresh martensite and tempered martensite.

(Number Density of TiC Having Circle Equivalent Diameter of 1 to 500 nm being $3.5\times10^4$ Particles/$Mm^2$ or More at Sheet Thickness ¼ Position)

TiC having a circle equivalent diameter of 1 to 500 nm has an action of trapping and detoxifying hydrogen that has intruded into steel. As the number density of TiC having a circle equivalent diameter of 1 to 500 nm increases, the hydrogen-trapping capability of TiC is enhanced, and the delayed fracture resistance properties of the steel sheet are improved. In addition, TiC having a circle equivalent diameter of 1 to 500 nm also has an action of suppressing the migration of dislocations inside the steel sheet. Therefore, an increase in the number density of TiC having a circle equivalent diameter of 1 to 500 nm also makes it, possible to improve the fatigue strength of the steel sheet.

In order to obtain these effects, in the steel sheet according to the present embodiment, the number density of TiC having a circle equivalent diameter of 1 to 500 nm is set to $3.5\times10^4$ particles/mm$^2$ or more at the sheet thickness ¼ position. The number density of TiC having a circle equivalent diameter of 1 to 500 nm at the sheet thickness ¼ position may be set to $4.5\times10^4$ particles/mm$^2$ or more, $5.5\times10^4$ particles/mm$^2$ or more, 6 $5\times10^4$ particles/mm$^2$ or more, $7.5\times10^4$ particles/mm$^2$ or more, or $8.5\times10^4$ particles/mm$^2$ or more.

The number density of TiC having a circle equivalent diameter of 1 to 500 nm at the sheet thickness ¼ position is preferably as large as possible and the upper limit thereof is not particularly limited, and the upper limit thereof may be set to, for example, $8.5\times10^4$ particles/mm$^2$. In addition, it is considered that TiC having a circle equivalent diameter of 3 to 300 nm is most effective for improving the properties of the steel sheet. Therefore, instead of limiting the number density of TiC having a circle equivalent diameter of 1 to 500 nm, or in addition to this limitation, the lower limit of the number density of TiC having a circle equivalent diameter of 3 to 300 nm may be set to $3.5\times10^4$ particles/mm$^2$, $4.5\times10^4$ particles/mm$^2$, $5.5\times10^4$ particles/mm$^2$, $6.5\times10^4$ particles/mm$^2$, $7.5\times10^4$ particles/mm$^2$, or $8.0\times10^4$ particles/mm$^2$, or the upper limit of the number density of TiC having a circle equivalent diameter of 3 to 300 nm may be set to $8.5\times10^4$ particles/mm$^2$.

The number density of TiC having a circle equivalent diameter of less than 1 nm and the number density of TiC having a circle equivalent diameter of more than 500 nm are not particularly limited. This is because TiC having a circle equivalent diameter of less than 1 nm and TiC having a circle equivalent diameter of more than 500 nm are presumed to have a low hydrogen-trapping capability and not to contribute to improvement in the delayed fracture resistance properties of the steel sheet. In addition, in a case where the Ti content, the N content, and the number density of TiC having a circle equivalent diameter of 1 to 500 nm are set within the above-described ranges, the majority of the Ti solid solutions that are contained in the steel sheet before annealing form TiC having a circle equivalent diameter of 1 to 500 nm, and the number of TiC having a circle equivalent diameter of less than 1 nm and the number of TiC having a circle equivalent diameter of more than 500 nm are naturally limited to a range where the properties of the steel sheet according to the present embodiment are not adversely affected. For the above-described reasons, the number density of TiC having a circle equivalent diameter of less than 1 nm and the number density of TiC having a circle equivalent diameter of more than 500 nm are not particularly limited.

(Value of Median Value of Mn Concentration+3σ being 5.00% or Less at Sheet Thickness ¼ Position)

In the steel sheet according to the present embodiment, the value of the median value of the Mn concentration+3σ at the sheet thickness 114 position is set to 5.00% or less. Here, the median value of the Mn concentration+3σ at the sheet thickness ¼ position is a value that is calculated using the Mn concentration measured at the sheet thickness ¼ position as the population and indicates that 99.7% of the measured values are within this range.

As the value of the median value of the Mn concentration+3σ decreases, the dispersion in the Mn concentration measured at the sheet thickness ¼ position decreases, and thus the degree of segregation of Mn decreases. The decrease in Mn segregation makes it difficult for intergranular cracking due to hydrogen to occur and makes it possible for the susceptibility to hydrogen embrittlement to decrease. The lower limit of the value of the median value of the Mn concentration+3σ does not need to be particularly specified and may be set to, for example, 3.20% or more, 3.40% or more, or 3.60% or more.

(Hardness Measured at Sheet Thickness ¼ Position of Steel Sheet: 1.30 Times or More Hardness Measured at Position 50 μm Deep from Surface of Steel Sheet)

Next, the hardness of the steel sheet according to the present embodiment will be described. In the steel sheet according to the present embodiment, the hardness measured at the sheet thickness ¼ position of the steel sheet is set to 1.30 times or more the hardness measured at a position 50 μm deep from the surface of the steel sheet. In this case, the surface layer of the steel sheet is provided with a soft layer formed by decarburization or the like. Delayed fracture is likely to occur when the steel sheet has been bent. The soft layer improves the bendability of the steel sheet. Therefore, the soft layer provided on the surface layer of the steel sheet, makes it possible to more effectively suppress delayed fracture. In addition, the soft layer also has an effect of suppressing the intrusion of hydrogen. However, in a case where the hardness measured at the sheet thickness ¼ position is less than 1.30 times the hardness measured at the position 50 μm deep from the surface of the steel sheet, it is considered that the surface layer of the steel sheet is not sufficiently softened and the effect of improving the delayed fracture resistance properties cannot be obtained. Therefore, the hardness measured at the sheet thickness ¼ position is set to 1.30 times or more the hardness measured at the position 50 μm deep, from the surface of the steel sheet. The hardness measured at the sheet thickness ¼ position may be 1.40 times or more, 1.50 times or more, or 1.60 times or more the hardness, measured at the position 50 μm deep from the surface of the steel sheet. The upper limit of a value obtained by dividing the hardness measured at the position 50 μm deep from the surface of the steel sheet by the hardness measured at the sheet thickness ¼ position does not need to be particularly specified and may be, for example, 1.70 times or less 1.80 times or less, or 1.90 times or less.

The methods for evaluating the metallographic structure, the number density of TiC, the segregation degree of Mn, and the hardness of the steel sheet according to the present embodiment are as described below.

The volume fraction of martensite and tempered martensite at the sheet thickness ¼ position is obtained by observing a range of ⅛ to ⅜ thickness, in which the ¼ position of the sheet thickness is centered, of an electron channeling contrast image for which a field emission-scanning electron microscope (FE-SEM) is used. These structures are more difficult to etch than ferrite and are thus present as protrusions on the structure observed section. Tempered martensite is a collection of lath-shaped crystal grains and contains an iron-based carbide having a major axis of 20 nm or more therein, and the carbide belongs to a plurality of variants that is, a plurality of iron-based carbide groups elongated in different directions. In addition, residual austenite is also present as protrusion on the structure observed section.

Therefore, the area ratio of the protrusions obtained by the above-described procedure is regarded as the total value of the volume fractions of martensite, tempered martensite, and residual austenite, and it becomes possible to correctly measure the total volume fraction of martensite and, tempered martensite by subtracting the volume fraction of residual austenite, which is measured by a procedure to be described below, from the total value of the volume fractions.

The volume fraction of residual austenite can be calculated by measurement where X-rays are used. A portion from the sheet surface of a sample to a depth ¼ position in the sheet thickness direction is removed by mechanical polishing and chemical polishing, the microstructural fraction of residual austenite is calculated from, the integrated intensity ratio of the diffraction peaks of (200) and (211) of a bcc phase and (200), (220), and (311) of an fcc phase obtained from the polished sample using MoKα rays as characteristic X rays, and this, is regarded as the volume fraction of residual austenite.

The number density of TiC having a circle equivalent diameter of 1 to 500 nm at the sheet thickness ¼ position was measured by a method to be described below. First, the steel sheet is cut perpendicularly to the surface of the steel sheet such that the cut surface is along the rolling direction, Next, a sample enabling the observation of a 10 μm×10 μm region is collected from the sheet thickness ¼ position by FIB processing, and a thin film sample having a thickness of 100 nm or more and 300 nm or less is produced. After that, the sample at the sheet thickness ¼ position was photographed at 10 visual fields with a field-emission transmission electron microscope at a magnification, of 20000 times. Precipitates in the visual fields were analyzed by EDS (energy dispersive X-ray analysis), the crystal structure analysis was performed by nano beam electron diffraction (NBD), and it was confirmed that the precipitates were TiC. TiC having a circle equivalent diameter of 1 to 500 nm was counted, and this number was divided, by the observed area, whereby the number density of TiC at the sheet thickness ¼ position can be obtained. The circle equivalent diameter of TiC refers to the diameter of a circle having the same area as the cross-sectional area of TiC that is observed in the above-described cross section.

The median value of the Mn concentration+3σ at the sheet thickness ¼ position is defined using the measurement results obtained using an EPMA (electron probe microanalyzer). Like the structure observation with the scanning electron microscope (SEM) described above, element concentration maps in a 35 μm×25 μm region are acquired at measurement intervals of 0.1 μm in the range of ⅛ to ⅜ thickness, in which the ¼ position of the sheet thickness is centered. A histogram of Mn concentration is obtained based on the data of the element concentration maps of 8 visual fields, the histogram of Mn concentration obtained by this experiment is approximated by a normal distribution, and the median value and the standard deviation σ are calculated. In the case of obtaining the histogram, the Mn concentration section is set to 0.1%.

A method for measuring the hardness at the sheet thickness ¼ position and a method for measuring the hardness at a depth of 50 μm from the surface of the steel sheet are as described below. First, a cut surface perpendicular to the rolling direction of the steel sheet is formed and polished. The rolling direction of the steel sheet can be easily presumed based on the elongation direction of the metallographic structure. Next, Vickers hardness is measured on the cut surface. The measurement places are a position at a depth of ¼ of the thickness of the steel sheet from the surface of the steel sheet, that is, a sheet thickness ¼ position, and a position of 50 μm deep from the surface of the steel sheet. A hardness is measured four times at each of the sheet thickness ¼ position and the 50 μm depth position. A load in the Vickers hardness measurement is set to 2 kgf. The average value of the hardness measurements at each, of the sheet thickness ¼ position and the 50 μm depth position is regarded as the hardness at each of the sheet thickness ¼ position and the hardness at, the 50 μm depth position.

The tensile strength of the steel sheet according to the present embodiment is 1310 MPa or more. This makes it possible to apply the steel sheet according to the present embodiment to various mechanical parts that require a high strength. The tensile strength of the steel sheet may be set to 1350 MPa or higher, 1400 MPa or higher, or 1450 MPa or higher. The upper limit of the tensile strength of the steel, sheet is not particularly specified and may be set to, for example, 1760 MPa or less 1700 MPa or less, or 1650 MPa or less.

The steel sheet according to the present embodiment may have a well-known surface treatment layer. The surface treatment layer is, for example, a plating, a chemical conversion layer, a coating, or the like. The plating is, for example, hot-dip galvanizing, hot-dip galvannealing, electro plating, aluminum plating, or the like. The surface treatment layer may be disposed on one surface of the steel sheet or may be disposed on both surfaces.

Next, a method for manufacturing a steel sheet according to the present embodiment will be described. However, the method for manufacturing a steel sheet according to the present embodiment is not particularly limited. Any steel sheet that satisfies the above-described requirements is regarded as the steel sheet according to the present embodiment regardless of manufacturing methods therefor. The manufacturing method to be described below is merely a preferable example and does not limit the steel sheet according to the present embodiment.

The method for manufacturing the steel sheet according to the present embodiment has a step of hot-rolling a cast piece having the above-described chemical composition of the steel sheet according to the present embodiment with a finish rolling end temperature set to the Ac3 point or higher to obtain a steel sheet, a step of coiling the steel sheet at a coiling temperature set to 500° C. or lower, a step of cold-rolling the steel sheet at a rolling reduction set to 0% to 20%, and a step of annealing the steel sheet in a temperature range of the Ac3 point or higher with an oxygen potential in a temperature range of 700° C. or higher set to −1.2 or higher and 0 or lower. At the time of the annealing, it is necessary to set the holding time within a temperature range of 500° C. to 700° C. within a predetermined range.

(Hot Rolling)

First, a cast piece having the above-described chemical composition of the steel sheet according to the present embodiment is hot-rolled to obtain a steel sheet (hot-rolled steel sheet). The finish rolling end temperature of the hot rolling, that is, the surface temperature of the steel sheet when the steel, sheet comes out of the final pass of the hot rolling machine is set to the Ac3 point, or higher. This prevents the formation of ferrite and pearlite in the steel sheet before annealing. When ferrite and/or pearlite is included in the steel sheet before annealing, there is a concern that the segregation of Mn may not be sufficiently reduced in the steel sheet after annealing.

The Ac3 point (° C.) is a value that is determined according to the chemical composition of the steel sheet and is calculated by substituting the contents of alloying elements into the following formula.

$$910-(203\times C^{1/2})+44.7\times Si-30\times Mn+700\times P-20\times Cu-15.2\times Ni-11\times Cr+31.5\times Mo+400\times Ti+104\times V+120\times Al$$

Here, the element symbols included in the formula mean the contents of the elements that are contained in the steel sheet in the unit of "mass %".

The hot rolling conditions other than, the finish rolling end temperature, such as the hot rolling start temperature and the rolling reduction, are not particularly limited. However, as described below, in the manufacture of the steel sheet according to the present embodiment, it is necessary to decrease the rolling reduction during cold rolling more than normal or to skip cold rolling. This may create a necessity of increasing the rolling reduction during the hot rolling more than normal. In addition, from the viewpoint of suppressing the formation of ferrite and pearlite in the hot-rolled steel sheet, the cooling rate after the hot rolling is preferably set to 5° C./sec or faster, 10° C./sec or faster, or 20° C./sec or faster at all time until the completion of coiling.

(Coiling of Steel Sheet)

Next, the hot-rolled steel sheet is coiled. The temperature of the steel sheet immediately after the hot rolling drops rapidly due to the exposure of the steel sheet, to the outside air; however, when the steel sheet is coiled, the area of the steel sheet that comes into contact with the outside air decreases, and the cooling rate of the steel sheet decreases significantly. In the method for manufacturing a steel sheet according to the present embodiment, the coiling temperature is set to 500° C. or lower, which is lower than normal. This is because the metallographic structure of the steel sheet before annealing mainly includes bainite and/or martensite. When ferrite and/or pearlite is included in the steel sheet before annealing, there is a concern that the segregation of Mn may not be sufficiently reduced in the steel sheet after annealing.

(Cold Rolling of Steel Sheet)

Next, a cold-rolled steel sheet may be obtained by cold-rolling the coiled steel sheet. However, the rolling reduction in the cold rolling is set to 20% or smaller. This is to suppress the introduction of dislocations into the steel sheet before annealing. Dislocations reduce Mn segregation in the steel sheet, but also promote the recrystallization of the structure of the steel sheet. When the dislocation density of the steel sheet before annealing is excessively increased, at the time of heating the steel sheet for annealing, crystal grains become coarse, the area of grain boundaries that act as TiC precipitation sites decreases, and the number of TiC particles decreases, From the viewpoint of ensuring the number of TiC particles, the rolling reduction in the cold rolling is preferably as small as possible and may be 0%. That is, the cold rolling may not be performed.

(Annealing of Steel Sheet by Heating, Temperature Holding, and Cooling of Steel Sheet)

In addition, the steel sheet (cold-rolled steel sheet or hot-rolled steel sheet) is annealed. The annealing is a heat treatment including the heating of the steel sheet to a temperature range of the Ac3 point or higher (austenite temperature range), the holding of the temperature of the steel sheet in the temperature range of the Ac3 point or higher, and the cooling the steel sheet. In a case where the holding temperature of the steel sheet is lower, than the Ac3 point, quenching becomes insufficient, and there is a risk that the amount of martensite may be insufficient or the strength of the steel sheet may be impaired.

In addition, during the annealing, the oxygen potential in a temperature range of at least 700° C. or higher is set to −1.2 or higher and 0 or lower. This decarburizes the surface layer of the steel sheet and makes it possible to form a soft layer. In a case where the oxygen potential is lower than −1.2, external oxidation occurs, and decarburization becomes insufficient. Therefore, the surface layer is softened insufficiently, and the delayed fracture resistance properties are impaired. On the other hand, in a case where the oxygen potential becomes higher than 0, the decarburization of the surface layer excessively proceeds, and the tensile strength of the steel sheet is impaired.

The oxygen potential during the annealing of the steel sheet is $\log(PH_2O/PH_2)$ in an atmosphere where the steel sheet is annealed. $PH_2O$ is the partial pressure of water vapor in the atmosphere where the steel sheet is annealed, and $PH_2$ is the partial pressure of hydrogen in the atmosphere where the steel sheet is annealed. Also, log is the common logarithm.

Furthermore, when the steel sheet is heated to a temperature range of the Ac3 point or higher in the annealing, it is necessary to hold the steel sheet within a temperature range of 500° C. to 700° C. for 70 to 130 seconds. In other words, the holding time that is a time from when the temperature of the steel sheet reaches 500° C. to when the temperature of the steel sheet reaches 700° C. during heating needs to be set within a range of 70 to 130 seconds. The temperature range of 500° C. to 700° C. is a temperature range in which TiC is precipitated. When the holding time in this temperature range during heating is shorter than 70 seconds, the amount of TiC precipitated is insufficient, which makes the number density of TiC having a circle equivalent diameter, of 1 to 500 nm insufficient. In addition, when the holding time in this temperature range during heating is longer than 130 seconds, TiC becomes coarse, which makes the number density of TiC having a circle equivalent diameter of 1 to 500 nm insufficient.

In addition, even when the steel sheet is cooled from the temperature range of the Ac3 point or higher in the annealing, it is necessary to hold the steel sheet within a temperature range of 700° C. to 500° C. for 4 to 25 seconds. In other words, the holding time that is a time from when the temperature of the steel sheet reaches 700° C. to when the temperature of the steel sheet reaches 500° C. during cooling needs to be set within a range of 4 to 25 seconds. Regarding the Ti solid solution in the steel sheet, part of TiC precipitated during heating for annealing dissolves in the temperature range of the Ac3 point or higher. Therefore, even after the steel sheet is annealed in the temperature range of the Ac3 point or higher, it is necessary to hold the steel sheet within the temperature range of 700° C. to 500° C. to precipitate TiC again. When the holding time in this temperature range during cooling is shorter than 4 seconds, the amount of TiC precipitated is insufficient, which makes the number density of TiC having a circle equivalent diameter of 1 to 500 nm insufficient. In addition, when the holding time in this temperature range during cooling is longer than 25 seconds, TiC becomes coarse, which makes the number density of TiC having a circle equivalent diameter of 1 to 500 nm insufficient.

As long as the above-described conditions are satisfied normal conditions in the annealing of high strength steel sheets can be appropriately adopted as the annealing conditions. For example, the annealing time is preferably set to 5 to 10 seconds, but is not limited thereto. In addition, the cooling rate of the steel sheet is also not particularly limited and can be appropriately selected according to required properties.

The method for manufacturing a steel sheet according to the present embodiment may include different steps. For example, the method for manufacturing a steel sheet according to the present embodiment may further have a step of tempering the annealed steel sheet. This makes it possible to further enhance the ductility of the steel sheet. The tempering conditions are not particularly limited, but it is preferable to set, for example, the tempering temperature within a range of 170° C. to 420° C. and the tempering time within a range of 10 to 8000 seconds. In addition, the method for manufacturing a steel sheet according to the present embodiment may have a step of performing hot-dip galvanizing, hot-dip galvannealing, electro plating, or aluminum plating on the annealed steel sheet. This makes it possible to further enhance the corrosion resistance of the steel sheet. In a case where both plating and tempering are performed on the steel sheet, the annealed steel sheet may be plated before tempering or after tempering.

EXAMPLES

The effect of one aspect of the present invention will be more specifically described using examples. Here, conditions in the examples are simply examples of conditions adopted to confirm the feasibility and effect of the present invention. The present invention is not limited to these examples of the conditions. The present invention is capable of adopting a variety of conditions within the scope of the gist of the present invention as long as the object of the present invention is achieved.

Various cast pieces having the chemical composition shown in Table 1 to Table 3 were hot-rolled, coiled, cold-rolled, and annealed, thereby manufacturing steel sheets. The remainders of the chemical composition of these steel sheets were iron and impurities. In Table 1 to Table 3, for the contents of elements that were intentionally not added, the cells are left blank. Finish rolling end temperatures, coiling temperatures, cold rolling reductions, heating temperatures during annealing (annealing temperatures), tempering temperatures, holding times during heating, holding times during cooling, and oxygen potentials in a temperature range of 700° C. or higher were as shown in Table 4-1 and Table 4-2. In addition, for the steel sheets for which the cold rolling reduction of 0% is shown, in Table 4-1 and Table 4-2, the cold rolling was skipped. For part of the steel sheets, tempering was performed after annealing, and the tempering conditions are shown in Table 4-1 and Table 4-2.

The volume fractions of martensite at the sheet thickness ¼ position, the number densities of TiC having a circle equivalent diameter of 1 to 500 nm at the sheet thickness ¼ position, the values of the median value of the Mn concentration+3σ at the sheet thickness ¼ position, the hardness of the steel sheets at the sheet thickness ¼ position, and the hardness at the position 50 μm deep from the surface of the steel sheet of the various steel sheets obtained by the above-described manufacturing method were measured and shown in Table 5-1 and Table 5-2. Methods for measuring these values were as described above. In addition, the proportions between the hardness measured at the sheet thickness ¼ position and the hardness measured at the position 50 μm deep from the surface of the steel sheet were calculated and also shown in Table 5-1 and Table 5-2.

Additionally, the delayed fracture resistance properties of the steel sheets were evaluated by a method to be described, below and shown in Table 6-1 and Table 6-2. For the steel sheets manufactured using the method for manufacturing a steel sheet according to the present embodiment, the delayed fracture resistance properties were evaluated according to the method described in Materia Japan (Bulletin of the Japan Institute of Metals), Vol. 44, No. 0.3 (2005) pp. 254 to 256. Specifically, steel sheet was sheared with a clearance of 10%, and then a U bending test was performed at 10 R. A strain gauge was attached to the center of the obtained test piece, and stress was applied by tightening both ends of the test piece with bolts. The applied stress was calculated from the monitored strain in the strain gauge. As a load stress, a stress corresponding to 0.8 times the tensile strength (TS) was applied. This is because the residual stress that is introduced during forming is considered to correspond to the TS of the steel sheet. The obtained U-bending test piece was immersed in an HCl aqueous solution having a pH of 3 at a liquid temperature of 25° C. and held under an atmospheric pressure of 950 to 1070 hPa for 48 hours, and the presence or absence of cracking was investigated.

The pass/fail criterion for the tensile strength, which is the strength of the steel sheet, was set to 1310 MPa or more. A steel sheet that satisfied this pass/fail criterion was judged to, be a steel sheet having a high strength.

The pass/fail criterion for the balance between strength and ductility of the steel sheet was set to tensile strength (TS)×elongation (EL) of 15000 MPa % or more. A steel sheet that satisfied this pass/fail criterion was judged to be a steel sheet having an excellent strength.

As the pass/fail criterion for the delayed fracture resistance properties of the steel sheet, a case where cracks having a length of more than 3 mm were observed in the U-bending test piece was evaluated as C, a case where fine cracks having a length of less than 3 mm were observed on the end surface was evaluated as B, a case where cracks were not observed was evaluated as A, cases where the evaluation was A were regarded as pass, and cases where the evaluation was B or C were regarded as fail. A steel sheet that satisfied these pass/fail criterion was judged to be a steel sheet having excellent delayed fracture resistance properties.

The pass/fail criterion for the fatigue resistance properties of the steel sheet was set to a yield ratio of 0.65 or more. A steel sheet that satisfied this pass/fail criterion was judged to be a steel sheet having excellent fatigue resistance properties.

TABLE 1

| No. | C | Si | Mn | P | S | Al | N | Ti |
|---|---|---|---|---|---|---|---|---|
| A | 0.291 | 0.38 | 2.0 | 0.0037 | 0.0008 | 0.085 | 0.0009 | 0.095 |
| B | 0.336 | 2.41 | 1.4 | 0.0035 | 0.0086 | 0.020 | 0.0001 | 0.049 |
| C | 0.265 | 1.09 | 3.4 | 0.0172 | 0.0080 | 0.008 | 0.0088 | 0.083 |
| D | 0.396 | 0.59 | 3.1 | 0.0024 | 0.0038 | 0.009 | 0.0042 | 0.070 |
| E | 0.232 | 0.15 | 2.2 | 0.0337 | 0.0017 | 0.007 | 0.0014 | 0.057 |
| F | 0.211 | 1.71 | 2.5 | 0.0312 | 0.0012 | 0.043 | 0.0006 | 0.056 |
| G | 0.315 | 0.90 | 2.8 | 0.0022 | 0.0008 | 0.012 | 0.0018 | 0.058 |
| H | 0.368 | 2.22 | 1.7 | 0.0023 | 0.0009 | 0.007 | 0.0009 | 0.062 |
| I | 0.408 | 1.43 | 1.5 | 0.0067 | 0.0009 | 0.079 | 0.0008 | 0.068 |
| J | 0.438 | 1.85 | 2.9 | 0.0041 | 0.0008 | 0.011 | 0.0003 | 0.053 |
| K | 0.271 | 1.87 | 1.9 | 0.0301 | 0.0008 | 0.068 | 0.0001 | 0.008 |
| L | 0.318 | 1.26 | 2.3 | 0.0125 | 0.0021 | 0.011 | 0.0005 | 0.020 |
| M | 0.281 | 0.90 | 2.3 | 0.0319 | 0.0075 | 0.017 | 0.0005 | 0.079 |
| N | 0.447 | 1.45 | 2.0 | 0.0026 | 0.0009 | 0.013 | 0.0002 | 0.052 |
| O | 0.411 | 1.14 | 1.4 | 0.0048 | 0.0085 | 0.007 | 0.0099 | 0.095 |
| P | 0.254 | 1.60 | 1.5 | 0.0018 | 0.0008 | 0.007 | 0.0008 | 0.082 |
| Q | 0.232 | 2.13 | 2.7 | 0.0025 | 0.0042 | 0.076 | 0.0018 | 0.058 |
| R | 0.382 | 0.06 | 2.9 | 0.0052 | 0.0019 | 0.042 | 0.0008 | 0.060 |
| S | 0.362 | 1.85 | 3.4 | 0.0155 | 0.0006 | 0.009 | 0.0010 | 0.089 |
| T | 0.217 | 0.34 | 2.5 | 0.0349 | 0.0006 | 0.008 | 0.0013 | 0.067 |

TABLE 1-continued

| No. | C | Si | Mn | P | S | Al | N | Ti |
|---|---|---|---|---|---|---|---|---|
| U | 0.333 | 0.56 | 1.8 | 0.0075 | 0.0005 | 0.088 | 0.0001 | 0.050 |
| V | 0.308 | 2.34 | 3.1 | 0.0029 | 0.0009 | 0.013 | 0.0078 | 0.090 |
| W | 0.190 | 0.77 | 2.7 | 0.0299 | 0.0017 | 0.041 | 0.0013 | 0.091 |
| X | 0.459 | 0.71 | 1.4 | 0.0031 | 0.0083 | 0.093 | 0.0012 | 0.076 |
| Y | 0.380 | 1.40 | 1.1 | 0.0044 | 0.0009 | 0.006 | 0.0014 | 0.057 |
| Z | 0.358 | 0.31 | 2.3 | 0.0335 | 0.0006 | 0.045 | 0.0106 | 0.082 |
| AA | 0.393 | 0.90 | 2.1 | 0.0340 | 0.0007 | 0.050 | 0.0001 | 0.004 |
| AB | 0.326 | 0.45 | 1.5 | 0.0018 | 0.0009 | 0.055 | 0.0009 | 0.005 |
| AC | 0.250 | 1.19 | 3.0 | 0.0273 | 0.0009 | 0.006 | 0.0010 | 0.108 |

TABLE 2

| No. | B | O | Mo | Nb | Cr | V | Co | Ni | Cu |
|---|---|---|---|---|---|---|---|---|---|
| A | | | | | | | | | |

TABLE 2-continued

| No. | B | O | Mo | Nb | Cr | V | Co | Ni | Cu |
|---|---|---|---|---|---|---|---|---|---|
| B | | | | | | | | | |
| C | | | | | | | | | |
| D | | | | | | | | | |
| E | | | | | | | | | |
| F | | | | | | | | | |
| G | | | | | | | | | |
| H | | | | | | | | | |
| I | | | | | | | | | |
| J | | | | | | | | | |
| K | | | | | | | | | |
| L | | | | | | | | | |
| M | 0.0010 | | | | | | | | |
| N | | | 0.080 | | 0.047 | | 0.390 | | |
| O | | | | 0.010 | 0.395 | | | 0.100 | 0.083 |
| P | | | | 0.015 | | 0.064 | | | |
| Q | | | | | | | 0.037 | 0.060 | |
| R | | 0.002 | | | | | | | |
| S | | | 0.019 | | 0.040 | | | | |
| T | 0.0020 | | | | | | | | |
| U | | 0.001 | | 0.016 | | 0.034 | | | |
| V | | | | | | | | | |
| W | | | 0.159 | | 0.299 | | | | 0.782 |
| X | | 0.001 | | 0.128 | | 0.406 | | | |
| Y | 0.0026 | | | | | | 0.313 | 0.041 | |
| Z | | | | | | | | | |
| AA | | | | | | | | | |
| AB | | | | | | | | | |
| AC | | | | | | | | | |

TABLE 3

| No. | W | Ta | Sn | Sb | As | Mg | Ca | Y | Zr | La | Ce | Note | Ti − 3.5 * N | Ac3 point |
|---|---|---|---|---|---|---|---|---|---|---|---|---|---|---|
| A | | | | | | | | | | | | Example | 0.092 | 808 |
| B | | | | | | | | | | | | Example | 0.049 | 883 |
| C | | | | | | | | | | | | Example | 0.052 | 798 |
| D | | | | | | | | | | | | Example | 0.055 | 746 |
| E | | | | | | | | | | | | Example | 0.052 | 800 |
| F | | | | | | | | | | | | Example | 0.054 | 868 |
| G | | | | | | | | | | | | Example | 0.052 | 778 |
| H | | | | | | | | | | | | Example | 0.059 | 862 |
| I | | | | | | | | | | | | Example | 0.065 | 841 |
| J | | | | | | | | | | | | Example | 0.052 | 797 |
| K | | | | | | | | | | | | Example | 0.008 | 863 |
| L | | | | | | | | | | | | Example | 0.018 | 801 |
| M | | | | | | | | | | | | Example | 0.077 | 830 |
| N | | | | | | | | | | | | Example | 0.051 | 805 |
| O | | | | | | | | | | | | Example | 0.060 | 823 |
| P | | | | | | | | | | | | Example | 0.079 | 876 |
| Q | | | | | | | | | | | | Example | 0.052 | 860 |
| R | | | | 0.002 | 0.005 | 0.020 | 0.004 | 0.004 | | | | Example | 0.057 | 733 |
| S | 0.009 | 0.085 | 0.004 | | | | | | 0.039 | 0.007 | 0.005 | Example | 0.086 | 816 |
| T | | | 0.037 | | | | | 0.004 | 0.002 | | | Example | 0.062 | 808 |
| U | | | | 0.003 | 0.002 | | | | 0.021 | 0.005 | | Example | 0.050 | 803 |
| V | | 0.012 | | | 0.004 | 0.005 | | | | 0.006 | 0.019 | Example | 0.063 | 849 |
| W | | | | | | | | | | | | Comparative Example | 0.086 | 823 |
| X | | | | 0.021 | 0.025 | 0.021 | 0.028 | 0.012 | | | | Comparative Example | 0.072 | 848 |
| Y | 0.012 | 0.086 | 0.031 | | | | | | 0.005 | 0.004 | 0.004 | Comparative Example | 0.052 | 840 |
| Z | | | | | | | | | | | | Comparative Example | 0.045 | 795 |
| AA | | | | | | | | | | | | Comparative Example | 0.004 | 791 |
| AB | | | | | | | | | | | | Comparative Example | 0.002 | 779 |
| AC | | | | | | | | | | | | Comparative Example | 0.105 | 835 |

TABLE 4-1

| No. | Steel kind | Hot rolling step: Finish rolling end temperature ° C. | Hot rolling step: Coiling temperature ° C. | Cold rolling step Cold rolling reduction % | Cold-rolled sheet annealing: Heating temperature ° C. | Holding time at 500° C. to 700° C. [s] | Holding time, at 700° C. to 500° C. [s] | Oxygen potential | Tempering temperature ° C. | Tempering time s | Note | Ac3 point |
|---|---|---|---|---|---|---|---|---|---|---|---|---|
| 1 | A | 990 | 76 | 7 | 862 | 102 | 17 | −1.1 | 234 | 39 | Example | 808 |
| 2 | B | 893 | 402 | 12 | 885 | 93 | 14 | −1.05 | 238 | 45 | Example | 883 |
| 3 | C | 978 | 146 | 1 | 830 | 75 | 23 | −0.85 | 203 | 51 | Example | 798 |
| 4 | D | 871 | 433 | 6 | 849 | 81 | 21 | −0.95 | 392 | 27 | Example | 746 |
| 5 | E | 909 | 457 | 13 | 803 | 77 | 18 | −0.77 | 315 | 48 | Example | 800 |
| 6 | F | 983 | 153 | 17 | 870 | 111 | 9 | −0.62 | — | — | Example | 868 |
| 7 | G | 965 | 313 | 2 | 876 | 78 | 10 | −1.02 | 245 | 36 | Example | 778 |
| 8 | H | 881 | 233 | 9 | 898 | 103 | 12 | −1.08 | 353 | 37 | Example | 862 |
| 9 | I | 912 | 192 | 7 | 852 | 100 | 13 | −0.72 | 324 | 21 | Example | 841 |
| 10 | J | 932 | 367 | 3 | 824 | 87 | 20 | −0.98 | 347 | 18 | Example | 797 |
| 11 | K | 880 | 90 | 17 | 870 | 106 | 23 | −0.92 | 227 | 13 | Example | 863 |
| 12 | L | 860 | 34 | 12 | 830 | 102 | 19 | −1.02 | 218 | 41 | Example | 801 |
| 13 | M | 962 | 112 | 15 | 880 | 98 | 16 | −1.07 | 239 | 20 | Example | 830 |
| 14 | N | 947 | 180 | 19 | 867 | 119 | 22 | −1.06 | 293 | 24 | Example | 805 |
| 15 | O | 890 | 263 | 11 | 889 | 102 | 11 | −1.1 | 287 | 31 | Example | 823 |
| 16 | P | 939 | 468 | 13 | 878 | 76 | 13 | −1.09 | 184 | 53 | Example | 876 |
| 17 | Q | 973 | 35 | 15 | 872 | 71 | 10 | −1.1 | — | — | Example | 860 |
| 18 | R | 895 | 402 | 19 | 834 | 97 | 20 | −0.97 | 189 | 7150 | Example | 733 |
| 19 | S | 924 | 104 | 5 | 844 | 102 | 16 | −0.7 | — | — | Example | 816 |
| 20 | T | 878 | 284 | 1 | 885 | 82 | 7 | −0.77 | — | — | Example | 808 |
| 21 | U | 864 | 264 | 9 | 880 | 72 | 14 | −0.85 | 206 | 3000 | Example | 803 |
| 22 | V | 947 | 330 | 17 | 876 | 99 | 11 | −0.77 | 213 | 56 | Example | 849 |
| 23 | A | 966 | 422 | 9 | 831 | 91 | 17 | −1.08 | 213 | 29 | Example | 808 |
| 24 | B | 912 | 30 | 13 | 892 | 103 | 15 | −1.03 | 188 | 31 | Example | 883 |
| 25 | C | 947 | 284 | 18 | 800 | 113 | 11 | −0.82 | 198 | 43 | Example | 798 |

35

TABLE 4-2

| No. | Steel kind | Hot rolling step: Finish rolling end temperature ° C. | Hot rolling step: Coiling temperature ° C. | Cold rolling step Cold rolling reduction | Cold rolled sheet annealing: Heating temperature ° C. | Holding time at 500° C. to 700° C. [s] | Holding time at 700° C. to 500° C. [s] | Oxygen potential | Tempering temperature ° C. | Tempering time s | Note | Ac3 point |
|---|---|---|---|---|---|---|---|---|---|---|---|---|
| 26 | D | 893 | 486 | 9 | 760 | 83 | 8 | −1.06 | 403 | 28 | Example | 746 |
| 27 | E | 867 | 136 | 6 | 835 | 93 | 10 | −0.82 | 280 | 33 | Example | 800 |
| 28 | F | 943 | 57 | 0 | 875 | 79 | 9 | −0.8 | — | — | Example | 868 |
| 29 | G | 959 | 388 | 6 | 811 | 92 | 19 | −1 | 258 | 47 | Example | 778 |
| 30 | H | 969 | 398 | 13 | 873 | 92 | 7 | −0.95 | 352 | 32 | Example | 862 |
| 31 | I | 923 | 449 | 14 | 894 | 101 | 10 | −1.06 | 291 | 16 | Example | 841 |
| 32 | J | 860 | 173 | 19 | 820 | 109 | 18 | −0.96 | 342 | 19 | Example | 797 |
| 33 | M | 910 | 309 | 2 | 891 | 75 | 9 | −0.47 | 362 | 12 | Example | 830 |
| 34 | N | 861 | 204 | 15 | 886 | 96 | 21 | −0.92 | 245 | 28 | Example | 805 |
| 35 | O | 978 | 102 | 18 | 852 | 129 | 22 | −0.95 | 276 | 29 | Example | 823 |
| 36 | W | 900 | 160 | 12 | 836 | 81 | 16 | −1.08 | 291 | 53 | Comparative Example | 823 |
| 37 | X | 933 | 234 | 5 | 864 | 97 | 11 | −0.83 | 198 | 26 | Comparative Example | 848 |
| 38 | Y | 911 | 357 | 10 | 892 | 93 | 9 | −1.05 | 182 | 141 | Comparative Example | 840 |
| 39 | Z | 937 | 257 | 2 | 865 | 77 | 15 | −0.81 | 248 | 33 | Comparative Example | 795 |
| 40 | AA | 888 | 372 | 16 | 827 | 73 | 12 | −1.1 | 201 | 47 | Comparative Example | 791 |
| 41 | AB | 853 | 162 | 15 | 825 | 76 | 9 | −1.02 | 267 | 52 | Comparative Example | 779 |
| 42 | P | 846 | 39 | 7 | 879 | 98 | 12 | −1.07 | 349 | 3671 | Comparative Example | 876 |

TABLE 4-2-continued

| No. | Steel kind | Hot rolling step: Finish rolling end temperature ° C. | Hot rolling step: Coiling temperature ° C. | Cold rolling step Cold rolling reduction | Cold rolled sheet annealing: Heating temperature ° C. | Holding time at 500° C. to 700° C. [s] | Holding time at 700° C. to 500° C. [s] | Oxygen potential | Tempering temperature ° C. | Tempering time s | Note | Ac3 point |
|---|---|---|---|---|---|---|---|---|---|---|---|---|
| 43 | Q | 920 | 516 | 19 | 870 | 81 | 11 | −1.02 | 287 | 43 | Comparative Example | 860 |
| 44 | R | 903 | 97 | 21 | 868 | 74 | 18 | −0.92 | 172 | 6231 | Comparative Example | 733 |
| 45 | F | 874 | 330 | 13 | 798 | 95 | 12 | −0.65 | 232 | 29 | Comparative Example | 868 |
| 46 | T | 995 | 439 | 9 | 813 | 85 | 7 | −1.3 | 312 | 36 | Comparative Example | 808 |
| 47 | AC | 937 | 132 | 17 | 865 | 101 | 19 | −0.89 | 271 | 62 | Comparative Example | 835 |
| 48 | U | 903 | 352 | 9 | 807 | 67 | 5 | −1.05 | 223 | 1231 | Comparative Example | 803 |
| 49 | V | 934 | 258 | 1 | 851 | 134 | 23 | −0.75 | 286 | 105 | Comparative Example | 849 |
| 50 | A | 872 | 482 | 15 | 811 | 73 | 2 | −0.93 | 241 | 53 | Comparative Example | 808 |
| 51 | B | 917 | 103 | 4 | 884 | 125 | 28 | −1.02 | 238 | 72 | Comparative Example | 883 |

TABLE 5-1

| No. | Steel kind | Total of martensite and tempered martensite % | Mn concentration: Median value + 3σ | Mn concentration: Median value | Mn concentration: σ | TiC Number density particles/mm$^2$ | Vickers hardness: Surface layer | Vickers hardness: Sheet thickness 1/4 position | Hardness ratio (hardness at sheet thickness 1/4 position/hardness of surface layer) |
|---|---|---|---|---|---|---|---|---|---|
| 1 | A | 98.2 | 4.39 | 2.35 | 0.68 | 4.8.E+05 | 392 | 527 | 1.34 |
| 2 | B | 96.2 | 4.68 | 2.46 | 0.74 | 9.0.E+04 | 408 | 540 | 1.32 |
| 3 | C | 99.6 | 4.89 | 2.58 | 0.77 | 3.7.E+04 | 358 | 492 | 1.38 |
| 4 | D | 95.3 | 4.81 | 2.53 | 0.76 | 5.2.E+04 | 403 | 562 | 1.39 |
| 5 | E | 95.9 | 4.82 | 2.54 | 0.76 | 4.0.E+04 | 330 | 429 | 1.30 |
| 6 | F | 95.6 | 4.22 | 2.21 | 0.67 | 8.2.E+05 | 389 | 510 | 1.31 |
| 7 | G | 97.1 | 4.86 | 2.55 | 0.77 | 3.9.E+04 | 375 | 534 | 1.42 |
| 8 | H | 95.3 | 4.39 | 2.32 | 0.69 | 5.8.E+05 | 392 | 539 | 1.38 |
| 9 | I | 94.2 | 4.40 | 2.33 | 0.69 | 5.4.E+05 | 403 | 546 | 1.35 |
| 10 | J | 93.4 | 4.74 | 2.52 | 0.74 | 6.0.E+04 | 409 | 540 | 1.32 |
| 11 | K | 94.8 | 4.29 | 2.10 | 0.73 | 5.7.E+06 | 358 | 506 | 1.41 |
| 12 | L | 96.7 | 4.40 | 2.45 | 0.65 | 4.4.E+06 | 372 | 536 | 1.44 |
| 13 | M | 97.9 | 4.10 | 2.15 | 0.65 | 1.9.E+06 | 364 | 528 | 1.45 |
| 14 | N | 96.4 | 3.80 | 2.09 | 0.57 | 4.2.E+07 | 419 | 552 | 1.32 |
| 15 | O | 95.2 | 4.29 | 2.28 | 0.67 | 6.7.E+05 | 411 | 554 | 1.35 |
| 16 | P | 96.1 | 4.87 | 2.56 | 0.77 | 3.8.E+04 | 353 | 461 | 1.30 |
| 17 | Q | 99.6 | 4.17 | 2.16 | 0.67 | 1.5.E+06 | 349 | 486 | 1.39 |
| 18 | R | 94.2 | 4.48 | 2.41 | 0.69 | 4.0.E+05 | 398 | 556 | 1.40 |
| 19 | S | 99.1 | 4.48 | 2.41 | 0.69 | 4.4.E+05 | 401 | 564 | 1.41 |
| 20 | T | 95.6 | 4.98 | 2.61 | 0.79 | 3.5.E+04 | 386 | 502 | 1.30 |
| 21 | U | 98.5 | 4.49 | 2.42 | 0.69 | 4.5.E+05 | 378 | 516 | 1.37 |
| 22 | V | 94.5 | 4.38 | 2.31 | 0.69 | 6.0.E+05 | 372 | 524 | 1.41 |
| 23 | A | 97.9 | 4.73 | 2.51 | 0.74 | 6.7.E+04 | 364 | 534 | 1.47 |
| 24 | B | 97.3 | 3.97 | 2.11 | 0.62 | 6.5.E+06 | 382 | 546 | 1.43 |
| 25 | C | 98.2 | 4.30 | 2.29 | 0.67 | 9.6.E+05 | 358 | 480 | 1.34 |

TABLE 5-2

| No. | Steel kind | Total of martensite and tempered martensite % | Mn concentration: Median value + 3σ | Mn concentration: Median value | Mn concentration: σ | TiC Number density particles/mm$^2$ | Vickers hardness: Surface layer | Vickers hardness: Sheet thickness 1/4 position | Vickers hardness: Hardness ratio (hardness at sheet thickness 1/4 position/hardness of surface layer) |
|---|---|---|---|---|---|---|---|---|---|
| 26 | D | 96.4 | 4.91 | 2.60 | 0.77 | 3.5.E+04 | 404 | 560 | 1.39 |
| 27 | E | 96.2 | 4.58 | 2.45 | 0.71 | 1.5.E+05 | 338 | 442 | 1.31 |
| 28 | F | 97.3 | 4.89 | 2.58 | 0.77 | 3.7.E+04 | 367 | 497 | 1.35 |
| 29 | G | 96.2 | 4.73 | 2.51 | 0.74 | 7.1.E+04 | 376 | 539 | 1.43 |
| 30 | H | 94.2 | 4.58 | 2.45 | 0.71 | 1.3.E+05 | 392 | 547 | 1.40 |
| 31 | I | 93.8 | 4.73 | 2.48 | 0.75 | 8.6.E+04 | 407 | 544 | 1.34 |
| 32 | J | 94.3 | 3.79 | 2.08 | 0.57 | 1.6.E+07 | 407 | 531 | 1.30 |
| 33 | M | 92.3 | 4.87 | 2.56 | 0.77 | 3.9.E+04 | 358 | 495 | 1.38 |
| 34 | N | 93.4 | 4.07 | 2.12 | 0.65 | 3.5.E+06 | 410 | 536 | 1.31 |
| 35 | O | 94.8 | 3.67 | 2.02 | 0.55 | 1.0.E+08 | 408 | 554 | 1.36 |
| 36 | W | 96.6 | 4.45 | 2.38 | 0.69 | 5.2.E+05 | 298 | 391 | 1.31 |
| 37 | X | 93.4 | 4.54 | 2.41 | 0.71 | 2.7.E+05 | 421 | 612 | 1.45 |
| 38 | Y | 96.3 | 5.09 | 2.63 | 0.82 | 1.6.E+05 | 397 | 562 | 1.42 |
| 39 | Z | 96.2 | 4.44 | 2.37 | 0.69 | 4.7.E+05 | 392 | 534 | 1.36 |
| 40 | AA | 95.6 | 4.73 | 2.51 | 0.74 | 3.2.E+04 | 390 | 560 | 1.44 |
| 41 | AB | 92.8 | 4.41 | 2.37 | 0.68 | 3.4.E+04 | 374 | 576 | 1.54 |
| 42 | P | 96.7 | 5.22 | 2.73 | 0.83 | 2.4.E+05 | 351 | 462 | 1.31 |
| 43 | Q | 97.2 | 5.14 | 2.62 | 0.84 | 4.0.E+04 | 343 | 477 | 1.39 |
| 44 | R | 92.6 | 5.18 | 2.69 | 0.83 | 1.4.E+04 | 396 | 554 | 1.40 |
| 45 | F | 88.2 | 4.44 | 2.37 | 0.69 | 2.8.E+05 | 315 | 410 | 1.30 |
| 46 | T | 96.1 | 4.86 | 2.55 | 0.77 | 4.0.E+04 | 372 | 428 | 1.15 |
| 47 | AC | 93.4 | 4.64 | 2.48 | 0.72 | 5.E+06 | 275 | 380 | 1.38 |
| 48 | U | 92.7 | 4.61 | 2.51 | 0.7 | 3.0.E+04 | 351 | 493 | 1.40 |
| 49 | V | 94.5 | 4.55 | 2.42 | 0.71 | 3.4.E+04 | 348 | 512 | 1.47 |
| 50 | A | 96.2 | 4.91 | 2.57 | 0.78 | 2.0.E+04 | 368 | 519 | 1.41 |
| 51 | B | 91.8 | 4.44 | 2.4 | 0.68 | 3.4.E+04 | 382 | 537 | 1.41 |

TABLE 6-1

| No. | Steel kind | Yield stress MPa | Yield ratio | Tensile strength MPa | Elongation % | Strength × elongation MPa % | Hydrogen embrittlement resistance |
|---|---|---|---|---|---|---|---|
| 1 | A | 1184 | 0.68 | 1738 | 8.9 | 15468 | A |
| 2 | B | 1174 | 0.66 | 1783 | 8.8 | 15690 | A |
| 3 | C | 1198 | 0.74 | 1625 | 9.3 | 15113 | A |
| 4 | D | 1286 | 0.69 | 1853 | 8.3 | 15380 | A |
| 5 | E | 1192 | 0.84 | 1416 | 10.8 | 15293 | A |
| 6 | F | 1199 | 0.71 | 1683 | 11.1 | 18681 | A |
| 7 | G | 1179 | 0.67 | 1762 | 8.6 | 15153 | A |
| 8 | H | 1274 | 0.72 | 1780 | 8.8 | 15664 | A |
| 9 | I | 1278 | 0.71 | 1802 | 8.7 | 15677 | A |
| 10 | J | 1275 | 0.72 | 1783 | 8.5 | 15156 | A |
| 11 | K | 1203 | 0.72 | 1670 | 9.0 | 15030 | A |
| 12 | L | 1187 | 0.67 | 1770 | 8.5 | 15045 | A |
| 13 | M | 1183 | 0.68 | 1742 | 8.7 | 15155 | A |
| 14 | N | 1281 | 0.70 | 1820 | 8.3 | 15106 | A |
| 15 | O | 1283 | 0.70 | 1829 | 8.9 | 16278 | A |
| 16 | P | 1201 | 0.79 | 1520 | 10.2 | 15504 | A |
| 17 | Q | 1140 | 0.71 | 1603 | 9.4 | 15068 | A |
| 18 | R | 1284 | 0.70 | 1835 | 8.2 | 15047 | A |
| 19 | S | 1287 | 0.69 | 1862 | 8.5 | 15827 | A |
| 20 | T | 1199 | 0.72 | 1656 | 11.0 | 18216 | A |
| 21 | U | 1189 | 0.70 | 1704 | 8.9 | 15166 | A |
| 22 | V | 1185 | 0.69 | 1728 | 8.7 | 15034 | A |
| 23 | A | 1179 | 0.67 | 1762 | 8.7 | 15329 | A |
| 24 | B | 1175 | 0.65 | 1802 | 8.4 | 15137 | A |
| 25 | C | 1201 | 0.76 | 1584 | 9.8 | 15523 | A |

TABLE 6-2

| No. | Steel kind | Yield stress MPa | Yield ratio | Tensile strength MPa | Elongation % | Strength × elongation MPa % | Hydrogen embrittlement resistance |
|---|---|---|---|---|---|---|---|
| 26 | D | 1285 | 0.70 | 1847 | 8.2 | 15145 | A |
| 27 | E | 1184 | 0.81 | 1460 | 10.3 | 15038 | A |
| 28 | F | 1180 | 0.72 | 1640 | 10.2 | 16728 | A |
| 29 | G | 1175 | 0.66 | 1779 | 8.5 | 15122 | A |
| 30 | H | 1279 | 0.71 | 1805 | 8.6 | 15523 | A |
| 31 | I | 1277 | 0.71 | 1794 | 8.4 | 15070 | A |
| 32 | J | 1269 | 0.72 | 1752 | 8.8 | 15418 | A |
| 33 | M | 1198 | 0.73 | 1632 | 9.4 | 15341 | A |
| 34 | N | 1272 | 0.72 | 1768 | 8.7 | 15382 | A |
| 35 | O | 1283 | 0.70 | 1830 | 8.3 | 15189 | A |
| 36 | W | 1200 | 0.93 | 1290 | 9.7 | 12513 | A |
| 37 | X | 1315 | 0.65 | 2018 | 6.6 | 13319 | C |
| 38 | Y | 1287 | 0.69 | 1856 | 8.2 | 15219 | B |
| 39 | Z | 802 | 0.63 | 1280 | 6.4 | 8192 | C |
| 40 | AA | 1083 | 0.59 | 1847 | 8.6 | 15884 | C |
| 41 | AB | 1092 | 0.57 | 1902 | 7.9 | 15026 | C |
| 42 | P | 1201 | 0.79 | 1523 | 10.8 | 16448 | B |
| 43 | Q | 1151 | 0.73 | 1574 | 11.3 | 17786 | B |
| 44 | R | 1074 | 0.59 | 1827 | 8.3 | 15164 | C |
| 45 | F | 1005 | 0.82 | 1230 | 13.1 | 16113 | A |
| 46 | T | 1193 | 0.84 | 1413 | 10.9 | 15402 | C |
| 47 | AC | 890 | 0.71 | 1254 | 13.5 | 16929 | A |
| 48 | U | 1069 | 0.64 | 1682 | 9.7 | 16315 | C |
| 49 | V | 1081 | 0.63 | 1716 | 8.9 | 15272 | C |
| 50 | A | 1059 | 0.61 | 1731 | 8.8 | 15233 | C |
| 51 | B | 1053 | 0.59 | 1772 | 8.6 | 15239 | C |

The examples that satisfied all of the requirements of the present invention were steel sheets having a high strength, an excellent balance between strength and ductility, excellent delayed fracture resistance properties, and excellent fatigue resistance properties. On the other hand, comparative examples that lacked one or more of the requirements of the present invention were evaluated as fail in one or more of the above-described evaluation criteria. In the tables, numerical values outside the scope of the invention or numerical values that do not meet the pass/fail criterion are underlined.

In a steel sheet 36, the C content was insufficient. In this steel sheet 36, it was not possible to ensure the tensile strength and TS×EL.

In a steel sheet 37, the C content was excessive. In this steel sheet 37, the strength became excessive, which made the yield ratio and TS×EL insufficient, and, furthermore, it was not possible to ensure the delayed fracture resistance properties.

In a steel sheet 38, Mn was insufficient. In this steel sheet 38, the value of the median value of the Mn concentration+3σ at the sheet thickness ¼ position became excessive. This is considered because ferrite appeared after hot rolling and thus strain was formed in the steel sheet nonuniformly due to the subsequent cold rolling. Therefore, in this steel sheet 38, it was not possible to ensure the delayed fracture resistance properties.

In a steel sheet 39, the N content was excessive. In this steel sheet 39, the steel sheet embrittled, and it was not possible to ensure the yield ratio, the tensile strength, and TS×EL.

In a steel sheet 40, the Ti content was insufficient, and the number density of TiC having a circle equivalent diameter of 1 to 500 nm at the sheet thickness ¼ position was insufficient. Therefore, in the steel sheet 40, it was not possible to ensure the delayed fracture resistance properties.

In a steel sheet 41, the chemical composition did not satisfy the relational formula between Ti and N. In this steel sheet 41, the number, density of TiC having a circle equivalent diameter of 1 to 500 nm at the sheet thickness ¼ position was insufficient. Therefore, in the steel sheet 41, it was not possible to ensure the delayed fracture resistance properties.

In a steel sheet 42, the value of the median value of the Mn concentration+3σ at the sheet thickness ¼ position became excessive. This is considered because the finish rolling end temperature of the steel sheet 42 was below the Ac3 point, and ferrite appeared after the end of hot rolling and thus strain was formed in the steel sheet nonuniformly due to the subsequent cold rolling. Therefore, in the steel sheet 42, it was not possible to ensure the delayed fracture resistance properties.

In a steel sheet 43, the value of the median value of the Mn concentration+3σ at the sheet thickness ¼ position became excessive. This is considered because the coiling temperature of the steel, sheet 43 was high, and ferrite appeared and thus strain was formed in the steel sheet nonuniformly due to the subsequent cold rolling. Therefore, in the steel sheet 43, it was not possible to ensure the delayed fracture resistance properties.

In a steel sheet 44, the value of the median value of the Mn concentration+3σ at the sheet thickness ¼ position became excessive, and, furthermore, the number density of TiC having a circle equivalent diameter of 1 to 500 nm at the sheet thickness ¼ position was insufficient. This is considered because the cold rolling reduction of the steel sheet 44 was too high. Therefore, in the steel sheet 44, it was not possible to ensure the yield ratio and the delayed fracture resistance properties.

In a steel sheet 45, the volume fraction of martensite at the sheet thickness ¼ position was insufficient. This is considered because the heating temperature during annealing of the steel sheet 45 was insufficient. Therefore, in the steel sheet 45, the tensile strength was insufficient.

In a steel sheet 46, the hardness measured at the position 50 μm deep from the surface of the steel sheet was excessive with respect to the hardness measured at the sheet thickness ¼ position. This is considered because the annealing atmosphere of the steel sheet 46 was inappropriate. Therefore, in the steel sheet 46, it was not possible to ensure the delayed fracture resistance properties.

In a steel sheet 47, the Ti content was excessive. Therefore, in the steel sheet 47, a large amount of TiC was precipitated, and the amount of a C solid solution decreased, and thus it was not possible to ensure the tensile strength.

In a steel sheet 48, the number density of TiC having a circle equivalent diameter of 1 to 500 nm at the sheet thickness ¼ position was insufficient. This is considered because, in the annealing of the steel sheet 48, the holding time at 500° C. to 700° C. vas insufficient at the time of heating the steel sheet up to a temperature range of the Ac3 point or higher. Therefore, in the steel sheet 48, it was not possible to ensure the yield ratio and the delayed fracture resistance properties.

In a steel sheet 49, the number density of TiC having a circle equivalent diameter of 1 to 500 nm at the sheet thickness ¼ position was insufficient. This is considered because, in the annealing of the steel sheet 49, the holding time at 500° C. to 700° C. was too long at the time of heating the steel sheet up to a temperature range of the Ac3 point or higher, Therefore, in the steel sheet 49, it was not possible to ensure the yield ratio and the delayed fracture resistance properties.

In a steel sheet 50, the number density of TiC having a circle equivalent diameter of 1 to 500 nm at the sheet thickness ¼ position was insufficient. This is considered because, in the annealing of the steel sheet 50, the holding time at 700° C. to 500° C. was insufficient at the time of cooling the steel sheet from the temperature range of the Ac3 point or higher. Therefore, in the steel sheet 50, it was not possible to ensure the yield ratio and the delayed fracture resistance properties.

In a steel sheet 51, the number density of TiC having a circle equivalent diameter of 1 to 500 nm at the sheet thickness ¼ position was insufficient. This is considered because, in the annealing of the steel sheet 51, the holding time at 700° C. to 500° C. was too long at the time of cooling the steel sheet from the temperature range of the Ac3 point or higher. Therefore, in the steel sheet 51 it was not possible to ensure the yield ratio and the delayed fracture resistance properties.

What is claimed is:

1. A steel sheet comprising, as a chemical composition, in a unit of mass %:

C: 0.20% or more and 0.45% or less;
Si: 0.01% or more and 2.50% or less;
Mn: 1.20% or more and 3.50% or less;
P: 0.040% or less;
S: 0.010% or less;
Al: 0.001% or more and 0.100% or less;
N: 0.0001% or more and 0.0100% or less;
Ti: 0.005% or more and 0.100% or less;
B: 0% or more and 0.010% or less;
O: 0.006% or less;
Mo: 0% or more and 0.50% or less;
Nb: 0% or more and 0.20% or less;
Cr: 0% or more and 0.50% or less;
V: 0% or more and 0.50% or less;
Cu: 0% or more and 1.00% or less;
W: 0% or more and 0.100% or less;
Ta: 0% or more and 0.10% or less;

Ni: 0% or more and 1.00% or less;
Sn: 0% or more and 0.050% or less;
Co: 0% or more and 0.50% or less;
Sb: 0% or more and 0.050% or less;
As: 0% or more and 0.050% or less;
Mg: 0% or more and 0.050% or less;
Ca: 0% or more and 0.040% or less;
Y: 0% or more and 0.050% or less;
Zr: 0% or more and 0.050% or less;
La: 0% or more and 0.050% or less;
Ce: 0% or more and 0.050% or less; and
a remainder consisting of Fe and impurities,
wherein a Ti content and a N content satisfy the following formula 1,
at a sheet thickness ¼ position, a metallographic structure includes 90% or more of martensite in terms of volume fraction,
at the sheet thickness ¼ position, a number density of TiC having a circle equivalent diameter of 1 to 500 nm is $3.5\times10^4$ particles/mm$^2$ or more,
at the sheet thickness ¼ position, a value of a median value of a Mn concentration+3σ is 5.00% or less,
a hardness measured at the sheet thickness ¼ position is 1.30 times or more a hardness measured at a position 50 μm deep from a surface of the steel sheet, and
a tensile strength is 1310 MPa or more, $$Ti-3.5\times N\geq0.003 \quad \text{(formula 1)}$$

here, element symbols Ti and N in the formula 1 mean the Ti content and the N content of the steel sheet.

2. The steel sheet according to claim 1, comprising:
hot-dip galvanizing, hot-dip galvannealing, electro plating, or aluminum plating.

3. A method for manufacturing a steel sheet comprising:
hot-rolling a cast piece having the chemical composition according to claim 1 with a finish rolling end temperature set to an Ac3 point or higher to obtain a steel sheet;
coiling the steel sheet at a coiling temperature set to 500° C. or lower;
cold-rolling the steel sheet at a rolling reduction set to 0% to 20%; and
annealing the steel sheet in a temperature range of the Ac3 point or higher with an oxygen potential in a temperature range of 700° C. or higher set to −1.2 or higher and 0 or lower,
wherein, when the steel sheet is heated up to the temperature range of the Ac3 point or higher in the annealing, the steel sheet is held in a temperature range of 500° C. to 700° C. for 70 to 130 seconds, and
when the steel sheet is cooled from the temperature range of the Ac3 point or higher in the annealing, the steel sheet is held in a temperature range of 700° C. to 500° C. for 4 to 25 seconds.

4. The method for manufacturing a steel sheet according to claim 3, further comprising:
tempering the annealed steel sheet.

5. The method for manufacturing a steel sheet according to claim 3, further comprising:
performing hot-dip galvanizing, hot-dip galvannealing, electro plating, or aluminum plating on the annealed steel sheet.

6. The method for manufacturing a steel sheet according to claim 4, further comprising:
performing hot-dip galvanizing, hot-dip galvannealing, electro plating, or aluminum plating on the annealed steel sheet.

7. A steel sheet comprising, as a chemical composition, in a unit of mass %:
C: 0.20% or more and 0.45% or less;
Si: 0.01% or more and 2.50% or less;
Mn: 1.20% or more and 3.50% or less;
P: 0.040% or less;
S: 0.010% or less;
Al: 0.001% or more and 0.100% or less;
N: 0.0001% or more and 0.0100% or less;
Ti: 0.005% or more and 0.100% or less;
B: 0% or more and 0.010% or less;
O: 0.006% or less;
Mo: 0% or more and 0.50% or less;
Nb: 0% or more and 0.20% or less;
Cr: 0% or more and 0.50% or less;
V: 0% or more and 0.50% or less;
Cu: 0% or more and 1.00% or less;
W: 0% or more and 0.100% or less;
Ta: 0% or more and 0.10% or less;
Ni: 0% or more and 1.00% or less;
Sn: 0% or more and 0.050% or less;
Co: 0% or more and 0.50% or less;
Sb: 0% or more and 0.050% or less;
As: 0% or more and 0.050% or less;
Mg: 0% or more and 0.050% or less;
Ca: 0% or more and 0.040% or less;
Y: 0% or more and 0.050% or less;
Zr: 0% or more and 0.050% or less;
La: 0% or more and 0.050% or less;
Ce: 0% or more and 0.050% or less; and
a remainder comprising Fe and impurities,
wherein a Ti content and a N content satisfy the following formula 1,
at a sheet thickness ¼ position, a metallographic structure includes 90% or more of martensite in terms of volume fraction,
at the sheet thickness ¼ position, a number density of TiC having a circle equivalent diameter of 1 to 500 nm is $3.5\times10^4$ particles/mm$^2$ or more,
at the sheet thickness ¼ position, a value of a median value of a Mn concentration+3σ is 5.00% or less,
a hardness measured at the sheet thickness ¼ position is 1.30 times or more a hardness measured at a position 50 μm deep from a surface of the steel sheet, and
a tensile strength is 1310 MPa or more, $$Ti-3.5\times N\geq0.003 \quad \text{(formula 1)}$$

here, element symbols Ti and N in the formula 1 mean the Ti content and the N content of the steel sheet.

* * * * *